US011781347B2

(12) United States Patent
Berger

(10) Patent No.: US 11,781,347 B2
(45) Date of Patent: Oct. 10, 2023

(54) LOCK ASSEMBLY ON A SECURITY DOOR

(71) Applicant: Securitech Group, Inc., Maspeth, NY (US)

(72) Inventor: Mark J Berger, New York, NY (US)

(73) Assignee: SECURITECH GROUP, INC., Maspeth, NY (US)

( * ) Notice: Subject to any disclaimer, the term of this patent is extended or adjusted under 35 U.S.C. 154(b) by 508 days.

(21) Appl. No.: 16/526,570

(22) Filed: Jul. 30, 2019

(65) Prior Publication Data

US 2020/0032554 A1 Jan. 30, 2020

Related U.S. Application Data

(60) Provisional application No. 62/712,000, filed on Jul. 30, 2018.

(51) Int. Cl.

| | |
|---|---|
| ***E05B 63/18*** | (2006.01) |
| ***E05C 1/12*** | (2006.01) |
| ***E05B 9/02*** | (2006.01) |
| ***E05B 41/00*** | (2006.01) |

(52) U.S. Cl.

CPC ..... *E05B 63/18* (2013.01); *E05B 9/02* (2013.01); *E05C 1/12* (2013.01); *E05B 41/00* (2013.01); *E05Y 2900/132* (2013.01)

(58) Field of Classification Search

CPC . E05B 63/18; E05B 9/02; E05B 41/00; E05B 63/20; E05B 2063/207; E05C 1/12; E05Y 2900/132; Y10T 292/82; Y10T 292/91; Y10T 292/096; Y10T 292/1014; Y10T 292/1016; Y10T 292/0969; Y10T 292/097; Y10T 292/0977

USPC ..... 292/347, 357, 137, 138, 163, 164, 169, 292/140; 70/DIG. 6, 145, 150, 151 R, 70/467–487

See application file for complete search history.

(56) References Cited

U.S. PATENT DOCUMENTS

| | | | | |
|---|---|---|---|---|
| 1,775,786 A * | 9/1930 | Steventon | E05B 83/02 | 292/169.21 |
| 6,109,666 A * | 8/2000 | Collet | E05B 63/20 | 292/167 |
| 6,622,534 B1 * | 9/2003 | Miller | G07C 9/0069 | 70/210 |
| 6,733,050 B1 * | 5/2004 | Yao | E05B 63/044 | 292/137 |

(Continued)

*Primary Examiner* — Christine M Mills
*Assistant Examiner* — Yahya Sidky
(74) *Attorney, Agent, or Firm* — Amster, Rothstein & Ebenstein LLP

(57) ABSTRACT

A lock assembly for a door includes a lock body for mounting above a door lever of the door and including a locking bolt supported in a housing of the lock body for movement between a retracted position and an extended position. The locking bolt is held in the retracted position and spring biased toward the extended position and releasable from the retracted position to move to the extended position in response to actuation of a trigger operatively coupled with the lock body. The lock assembly further includes a door lever assembly adapted for mounting on the door lever in rotative fixed relationship with the door lever, and operatively coupled with the locking bolt so that rotation of the door lever assembly causes movement of the locking bolt from the extended position to the retracted position.

13 Claims, 23 Drawing Sheets

(56) References Cited

U.S. PATENT DOCUMENTS

| | | | | |
|---|---|---|---|---|
| 2005/0127691 | A1* | 6/2005 | Shen | E05B 15/02 292/336 |
| 2013/0015672 | A1* | 1/2013 | Nadgouda | E05B 17/0058 292/202 |
| 2018/0187464 | A1* | 7/2018 | Moon | E05B 59/00 |
| 2019/0145130 | A1* | 5/2019 | Affan | E05C 1/004 292/144 |

* cited by examiner

LOCK ASSEMBLY ON A SECURITY DOOR

RELATED APPLICATION

This application claims the priority of U.S. Provisional Application Ser. No. 62/712,000 filed Jul. 30, 2018 pursuant to 35 U.S.C. 119(a)-(d), the content of which is incorporated herein by reference in its entirety as if fully set forth herein.

FIELD OF THE INVENTION

The present invention concerns locks with spring-biased bolts, for mounting on the surface of doors for securing the doors against unauthorized entry while maintaining single motion egress.

BACKGROUND OF THE INVENTION

In order to secure a door against unauthorized entry, a lock with a locking bolt can be installed on the door. The locking bolt is operable by a person inside the room, typically with a thumbturn or a key. The known locking bolts have drawbacks. They are not optimal in situations that require securing of the door very quickly in high-stress situations such as those that require preventing an intruder from entering the room, for example a classroom. In such situations, high stress and panic may cause a person inside the room to turn the thumbturn in the wrong direction, causing delay in locking the door. With an approaching intruder in close range, even seconds can make a difference between being able to or failing to lock the door in time. Furthermore, keys for closing the locking bolt may not be readily at hand or misplaced, resulting in further delays in locking the door.

It is therefore an object of the present invention to overcome these prior art shortcomings and provide a locking bolt assembly that can be operated easily and quickly and safely also in situations of high stress.

SUMMARY OF THE INVENTION

According to one aspect of the present invention a lock assembly for a door includes a lock body for mounting above a door lever of the door and comprising a locking bolt supported in a housing of the lock body for movement between a retracted position and an extended position, said locking bolt being held in the retracted position in opposition to a spring force biasing the locking bolt toward the extended position; a trigger operatively coupled with the locking bolt and actuatable to release the locking bolt from the retracted position; and a door lever assembly adapted for mounting on the door lever in rotative fixed relationship with the door lever, and operatively coupled with the locking bolt so that rotation of the door lever assembly causes movement of the locking bolt from the extended position to the retracted position.

According to another advantageous feature of the invention, the trigger is actuatable in response to a force applied on the trigger in a direction normal to and in the direction of an outer surface of the housing.

The lock assembly according to the invention can be retrofitted on existing doors having a door lever. The door with the lock assembly according to the invention is locked by pushing the trigger and is unlocked by turning the door lever which results in rotation of the door lever assembly and movement of the bolt from its extended position to its retracted position. The lock assembly thus advantageously enables adding an easy to deploy locking bolt to an existing latch-only lockset and maintaining single motion egress from the room secured by the locked door.

According to another advantageous feature of the invention, the door lever assembly is operatively coupled with the locking bolt via a pivot arm supported in the housing for pivoting between an upper position and a lower position, wherein movement of the pivot arm from the lower to the upper position causes movement of the locking bolt from the extended position to the retracted position, and rotation of the door lever assembly causes pivoting of the pivot arm from the lower position to the upper position.

According to another advantageous feature of the invention, the lock body further comprises a bolt stopper supported in the housing for pivoting in response to actuation of the trigger from a holding position in which the bolt stopper holds the locking bolt in the retracted position, to a release position permitting movement of the locking bolt from the retracted to the extended position.

According to another advantageous feature of the invention, the lock assembly further includes a cover assembly for mounting on the lock body, the cover assembly including a cover and a pushbutton supported in the cover for movement in a direction normal to an outer surface of the cover for actuation of the trigger.

According to another advantageous feature of the invention, the door lever assembly includes a top bracket and a bottom bracket adapted for mounting about the shaft of the door lever so that the shaft of the door lever is received between the top bracket and the bottom bracket.

According to another advantageous feature of the invention, the door lever assembly includes an actuator arm extending radially from the door lever assembly in a direction of the pivot arm of the lock body, wherein rotation of the door lever assembly causes engagement of the actuator arm on the pivot arm and movement of the pivot arm from the lower to the upper position.

According to another advantageous feature of the invention, the door lever assembly further includes a threaded bolt received in an oblong hole provided in the actuator and extending along a longitudinal extent of the actuator arm, and a roller being rotatably received on the threaded bolt, wherein the threaded bolt is adapted for adjustment of a position of the threaded bolt in the oblong hole along the longitudinal extent of the actuator arm According to another advantageous feature of the invention, the door lever assembly is movable without obstruction by the pivot arm of the lock body when the pivot arm is in the upper position.

BRIEF DESCRIPTION OF THE DRAWINGS

Other features and advantages of the present invention will be more readily apparent upon reading the following description of currently preferred exemplified embodiments of the invention with reference to the accompanying drawing, in which:

FIG. 24 B shows the lock body of FIG. 24A with the inner late partially broken away;

DETAILED DESCRIPTION OF THE INVENTION

Figure 1:
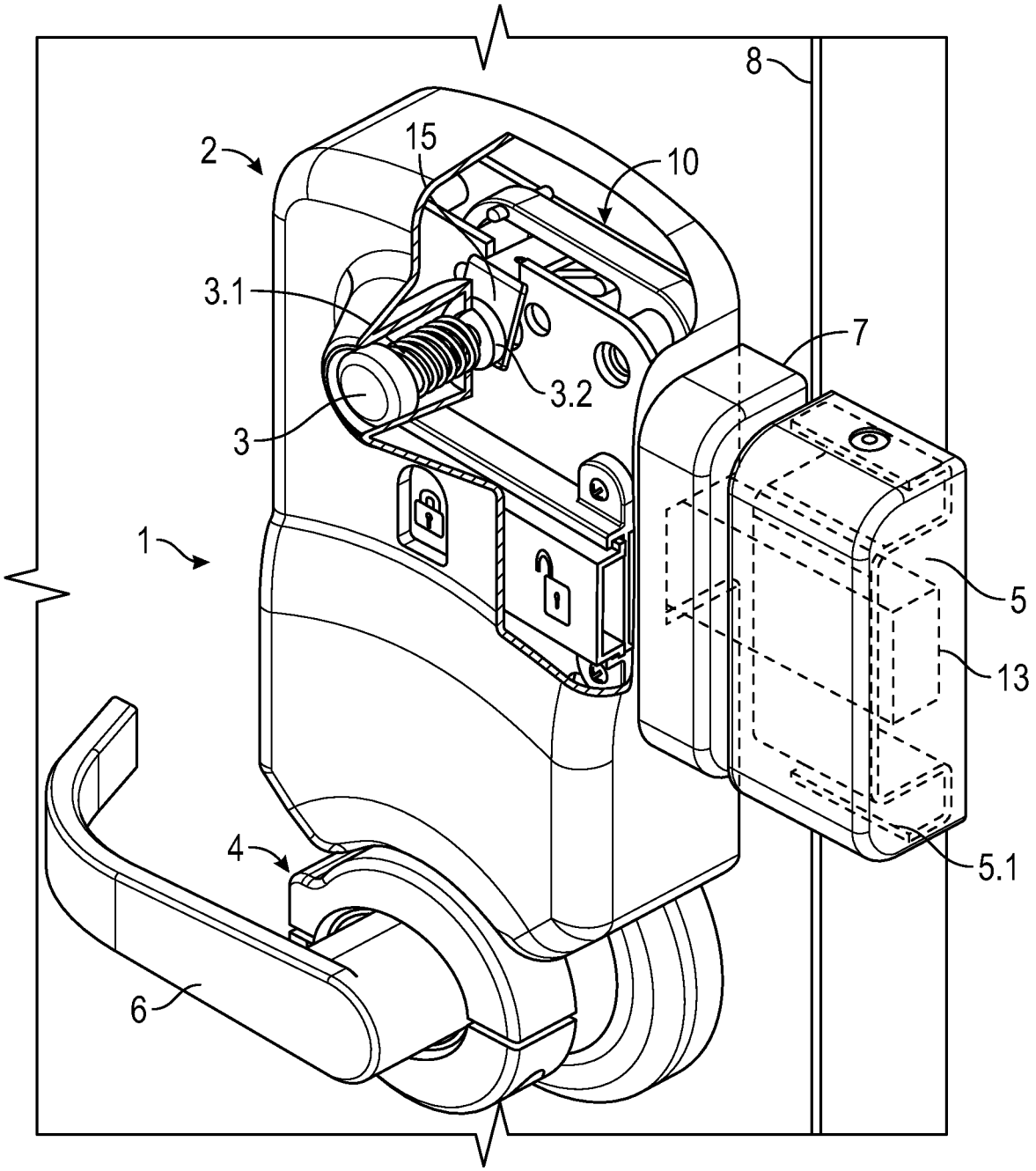
FIG. 1 is a perspective view of an embodiment of the lock assembly according to the present invention mounted on a door.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive have been omitted.

As used herein, the terms "inner" and "outer" refer to the relative position of components of the lock assembly in relation to the inner side and outer side of a door on which the lock assembly is installed. "Inner" means closer to the inner side of the door and "outer" means closer to the outer side of the door.

As used herein, the terms clockwise and counter clockwise refer to the direct of rotation of a component of the lock assembly as viewed in a direction from inner side to outer side of the door on which the lock assembly is installed.

Referring to FIG. 1, an embodiment of a lock assembly according to the present invention is shown and is generally designated by reference numeral 1. The lock assembly 1 is mounted on a door 8 that opens toward the inside of a room with the door lever 6 situated on the right side of the door 8 when viewed from inside the room. The inside surface of the door 8 is substantially flush with the inside surface of the doorframe. The embodiment of the lock assembly 1 shown in FIG. 1 includes a lock body 10, a cover assembly 2, a door lever assembly 4, a bolt cover 7, a strike 5.1 and a strike cover 5.

Figure 2:
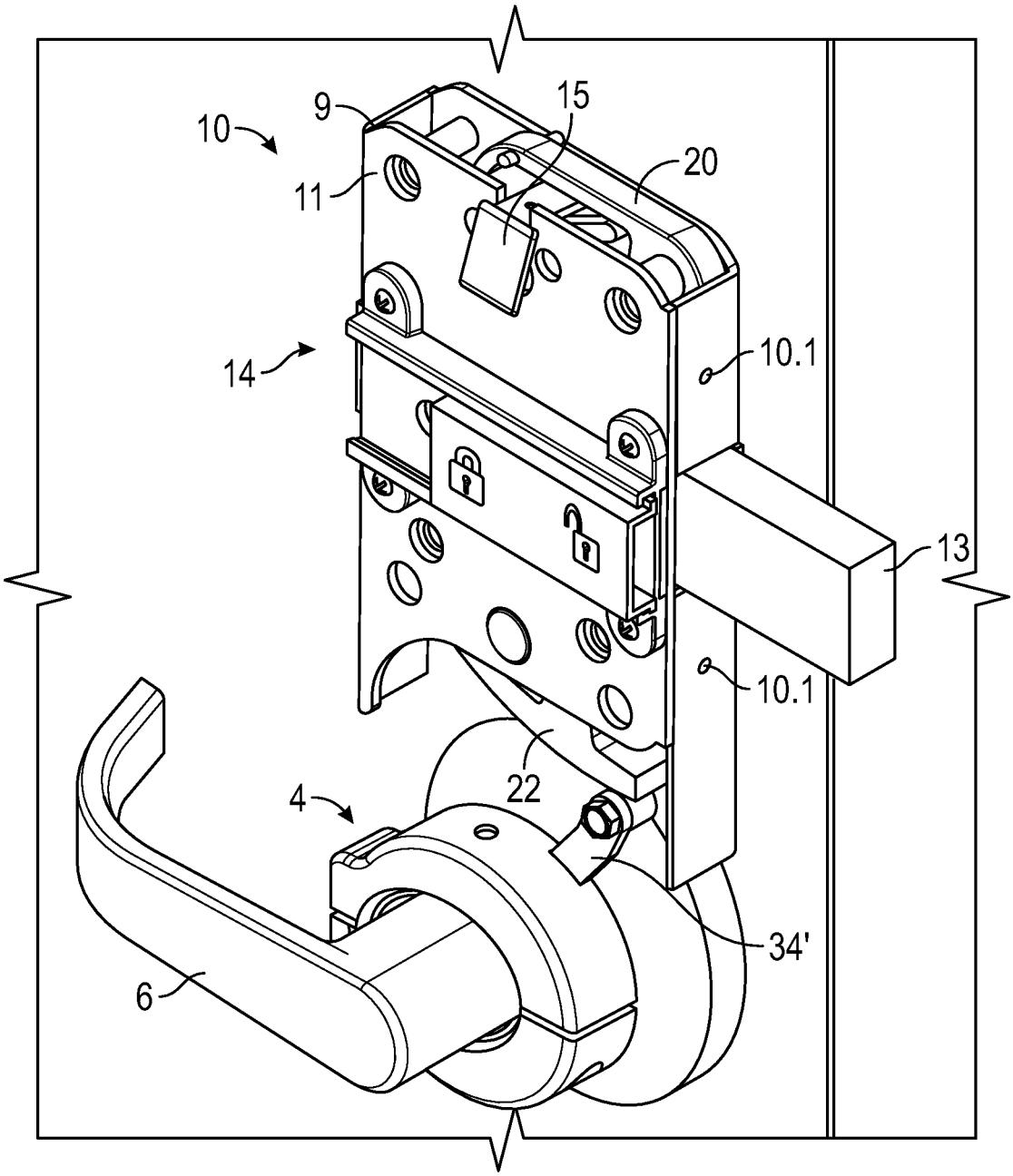
FIG. 2 shows the lock assembly of FIG. 1 with the cover assembly, bolt cover and strike cover removed.

FIG. 2 shows the lock assembly 1 with the cover assembly 2, the bolt cover 7 and the strike cover 5 removed. The lock body 10 has a housing 9 and a locking bolt 13 supported in the housing 9 for movement between a retracted position and an extended position. In FIG. 1, the locking bolt 13 is shown in its extended position and received in strike 5.1 mounted on the doorframe opposite the lock body 10. The lock body 10 also has a trigger 15, which can be actuated to trigger movement of the locking bolt 13 from its retracted position to its extended position. The lock body 10 further includes an indicator assembly 14 for indicating whether the locking bolt 13 is in the retraced or the extended position.

FIG. 2 also shows the door lever assembly 4 mounted on the shaft of the door lever 6. The door lever assembly 4 is mounted on the shaft of the door lever 6 so as to rotate with the shaft when the door lever 6 is turned to open the door. In the shown embodiment, the door lever assembly 4 includes actuator arm 34', which interacts with pivot arm 22 of the lock body 10 when the door lever assembly 4 rotates with the door lever shaft, which causes return of the locking bolt 13 from the extended position to the retracted position. The interaction between the door lever assembly 4 and the lock body 10 and return of the locking bolt 13 from the extended to the retracted position will be described in more detail below.

Figure 3:
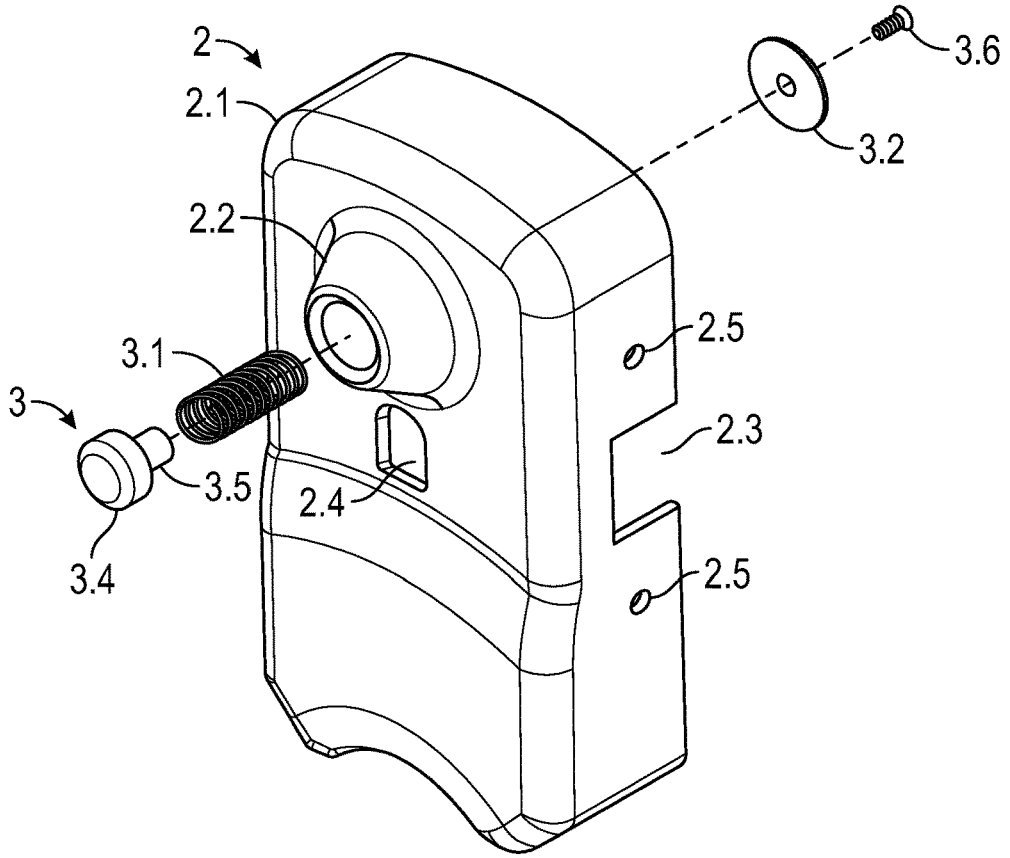
FIG. 3 shows an exploded view of the cover assembly shown in FIG. 1.

Referring to FIG. 3, there is shown an exploded view of the cover assembly 2 shown in FIG. 1. The cover assembly 2 includes a cover 2.1 with a receptacle 2.2. The cover assembly 2 further includes a pushbutton 3 which has a head 3.4 and a shaft 3.5 and is received in the receptacle 2.2. The pushbutton 3 is movable in the receptacle 2.2 between a distal position and a proximate position with respect to the lock body 10 and is biased toward the distal position by spring 3.1 received on the shaft 3.5 of the pushbutton 3. A washer 3.2 is fixed on the free end of the shaft 3.5 with a screw 3.6. The cover 2.1 has an opening 2.3 for passage of the locking bolt 13 and a window 2.4 through which the symbols of the indicator assembly 14 are visible from outside the housing 2.1. In the shown embodiment, the pushbutton 3 is recessed with respect to the receptacle 2.2. This advantageously helps preventing unintended triggering of the pushbutton 3 for example when a person passes by the lock assembly and inadvertently contacts the pushbutton.

Referring again to FIG. 1, the pushbutton 3 is received in a cylindrical portion of the receptacle 2.2. The cylindrical portion has a first opening distal to the lock body 10 to provide access to the pushbutton 3, and a second opening opposite the first opening and proximate to the lock body 10. The second opening is sized to permit passage therethrough of the shaft 3.5 of the pushbutton 3 when the pushbutton is pushed toward the lock body 10. FIG. 1 also shows that the pushbutton 3 is positioned so that the washer 3.2 is aligned with trigger 15 when the cover assembly 2 is mounted on the lock body 10. Pushing the pushbutton 3 in the direction of the trigger 15 causes actuation of the trigger 15 and triggers movement of the locking bolt 13 from the retracted position to the extended position as explained in more detail below.

When the pushbutton 3 is pushed from its initial position into the receptacle 2.2 toward the trigger 15, spring 3.1 becomes compressed between the head 3.4 of the pushbutton 3 and the rim of the second opening 2.6 of the cylindrical portion of the receptacle 2.2 and biases the pushbutton 3 toward its initial position. The washer 3.2 engages on the end of the cylindrical portion of the receptacle 2.2 that faces the lock body 10 and retains the pushbutton 3 in the receptacle 2.2 against the spring force exerted by spring 3.1.

Figure 4:
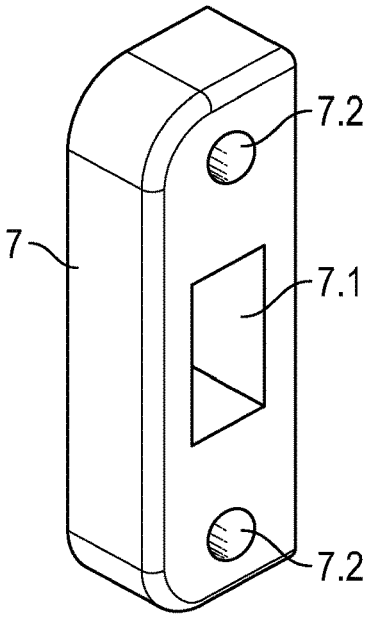
FIG. 4 shows a perspective view of the bolt cover shown in FIG. 1.

Referring now to FIG. 4, there is shown a perspective view of the bolt cover 7 of FIG. 1. The bolt cover 7 has a through-opening 7.1 for passage of the locking bolt 13, and holes 7.2 that align with the holes 2.5 of the cover 2.1 and with the holes 10.1 of the lock body 10. The bolt cover 7 can be secured to the cover 2.1 by passing screws through openings 7.2 and 2.5 and threadably engaging the screws in the holes 10.1 of the lock body 10.

Figure 5:
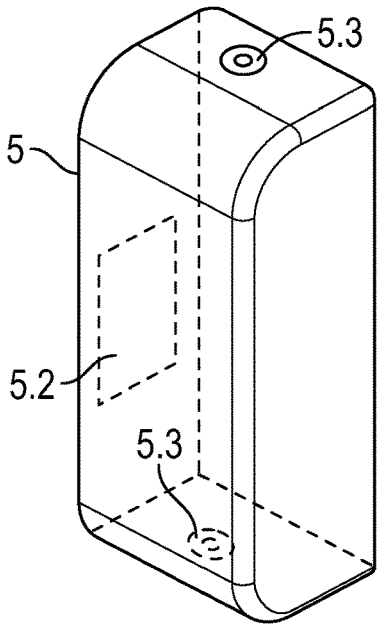
FIG. 5 shows a perspective view of the strike cover shown in FIG. 1.

FIG. 5 shows a perspective view of the strike cover 5 of FIG. 1, which is shaped to receive and to cover strike 5.1. The strike cover 5 has a through-opening 5.2 for passage of the locking bolt 13, and holes 5.3 for securing the strike cover 5 in corresponding holes provided in horizontal legs of the strike 5.1 by means of screws.

In other embodiments, the lock assembly according to the invention may only include the lock body 10 and the door lever assembly 4.

Figure 6:
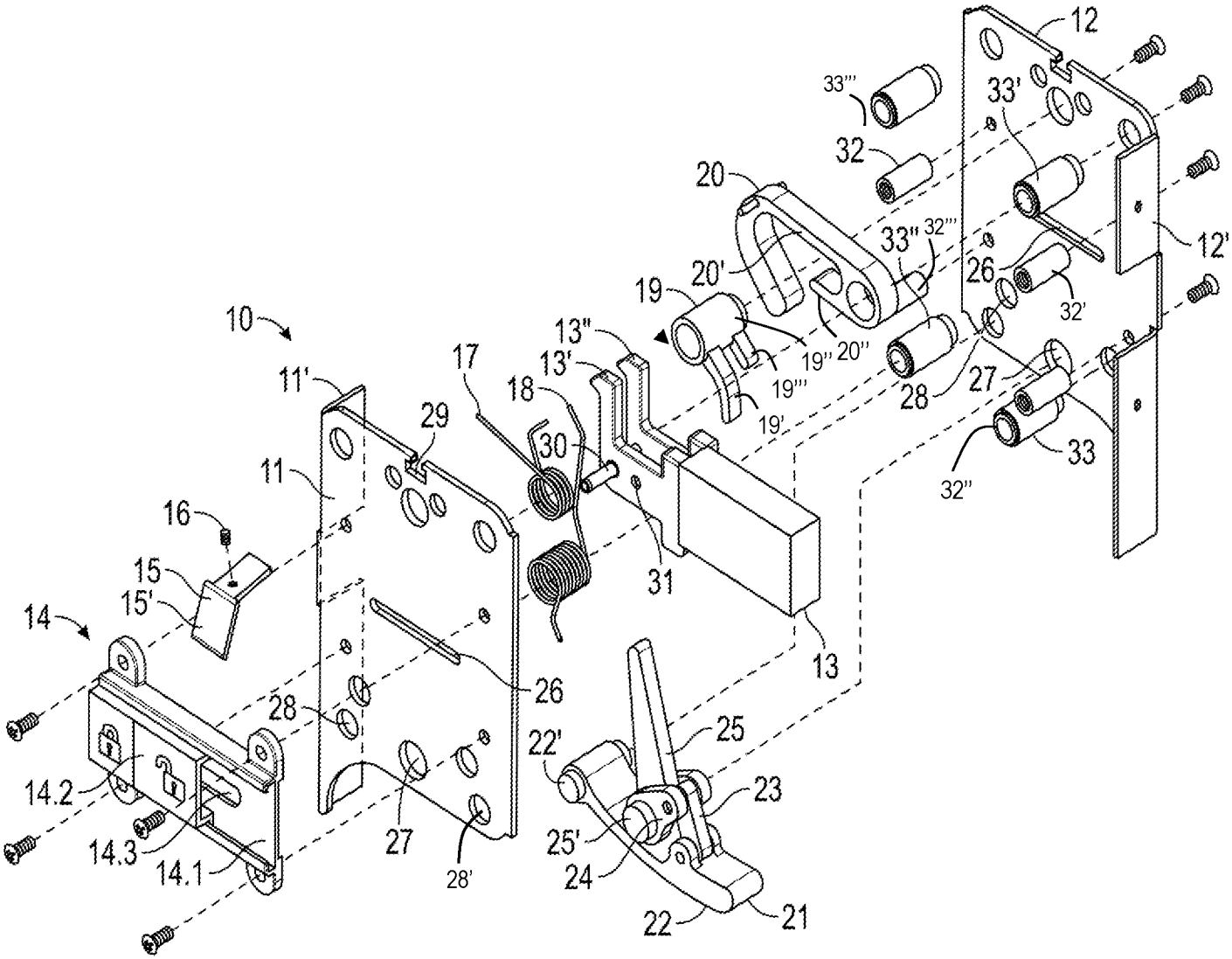
FIG. 6 is an exploded view of the lock body shown in FIG. 2.
Figure 8:
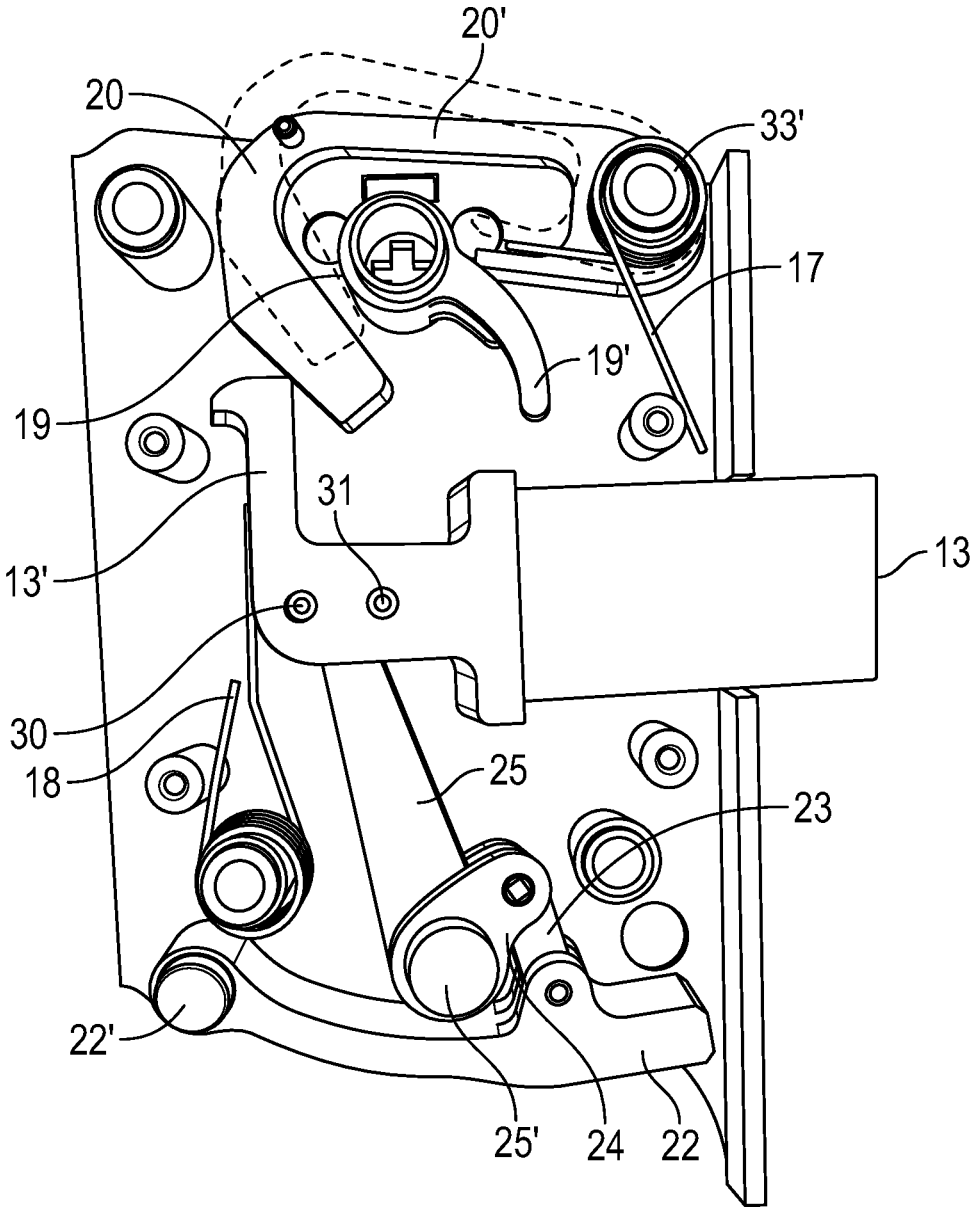
FIG. 8 is an internal view of the lock body shown in FIG. 2 taken from the side of the inner plate with the locking bolt in the retracted position.
Figure 9:
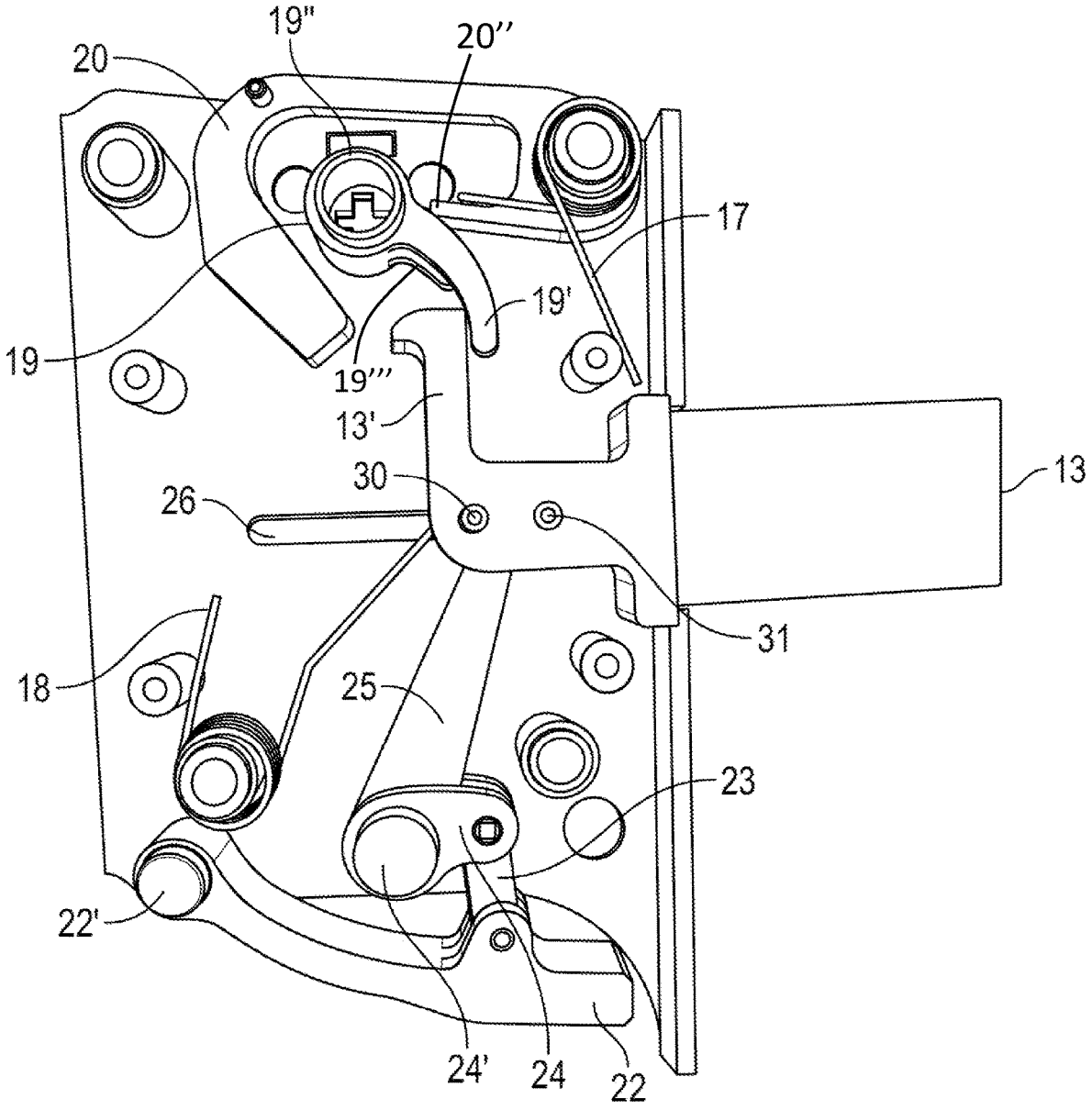
FIG. 9 shows the lock body of FIG. 8 with the locking bolt in the extended position.

In the following, the interaction and relative arrangement of the components of the lock body 10 is explained with reference to FIGS. 6 and 8-10. FIG. 6 shows a right side exploded view of the lock body 10 shown in FIG. 2. FIGS. 8 and 9 show respective internal views of the lock body 10 taken from the side of the inner plate 11, with the inner plate 11 removed.

In FIG. 8, the locking bolt 13 is shown in the retracted position and in FIG. 9 in the extended position. As shown in FIG. 6, the inner plate 11 and the outer plate 12 have angled portions that form front and rear walls 12' and 11' of the housing 9, respectively. The front wall 12' has an opening for the locking bolt 13. Bushings 33, 33', 33", 33'" and 32, 32', 32", 32'" are provided as spacers between the inner plate 11 and the outer plate 12. The inner and outer plates 11, 12 are held together by screws received in respective holes in the inner and outer plate and engaged in internal threads of bushings 32, 32', 32", 32'".

The locking bolt 13 has inner and outer legs 13' and 13" and pins 30 and 31. Pin 30 traverses the inner and outer legs 13', 13" of the locking bolt 13 and protrudes from either side of the locking bolt 13, while pin 31 extends between legs 13' and 13". Pin 30 is received in respective horizontal slots 26 formed in the inner plate 11 and the outer plate 12 and slidably supports the locking bolt 13 in the horizontal slots 26 for movement between a retracted and an extended position. Spring 18 is mounted on bushing 33" and engages on the inner leg 13' of the locking bolt 13 and biases the locking bolt 13 toward the extended position. Bolt stopper 20 is mounted on spacer 33' for pivoting about the bushing 33' between an upper position (indicated by the dashed outline) and a lower position and is biased toward the lower position by spring 17 mounted on bushing 33'. In the lower position, the bolt stopper 20 engages with outer leg 13" of the locking bolt 13 and holds the locking bolt 13 in the retracted position against the bias of spring 18. In the upper position, the bolt stopper 20 permits movement of the locking bolt 13 from the retracted to the extended position.

The lock body 10 also includes bolt arm assembly 21, which comprises a lower pivot arm 22 and an upper pivot arm 25 articulately connected to each other via connecting element 23. The pivot arms 22, 25 are pivotally supported in respective openings 27, 28 formed in the inner plate and outer plate 11, 12. The free end of pivot arm 25 engages between the inner and outer legs 13', 13" of locking bolt 13 and between pin 30 and 31. Movement of the locking bolt 13 between the retracted and the extended position causes pivoting of the generally vertical pivot arm 25 in clockwise (CW) or counter clockwise (CCW) direction, respectively, about pivot point 25'. Pivoting of upper pivot arm 25 in CW direction causes downward pivoting of lower pivot arm 22 and CCW pivoting of upper pivot arm 25 causes upward pivoting of lower pivot arm 22.

The lock body 10 also includes a trigger 15 for moving the bolt stopper 20 from the lower position to the upper position. The trigger 15 is pivotably mounted in opening 29 of the inner plate 11 and has a horizontal portion that engages through opening 29 and underneath the horizontal portion 20' of the bolt stopper 20. Pushing on the downward-pointing portion 15' of the trigger 15 in the direction of the lock body 10 causes upward pivoting of the horizontal portion of the trigger 15 and as a result upward pivoting of the bolt stopper 20 to its upper position.

Figure 10A:
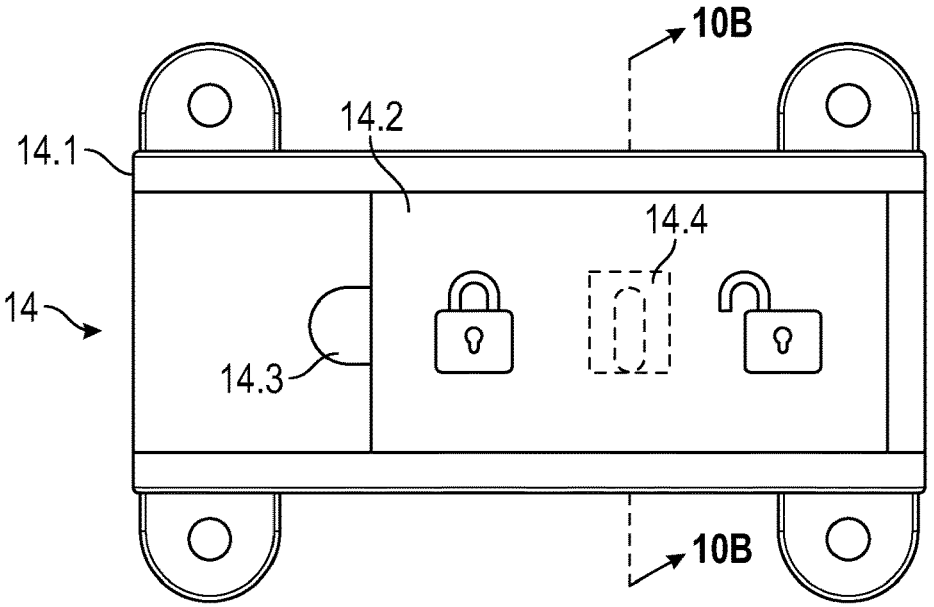
FIG. 10A is an elevational view of the indicator assembly shown in FIG. 6.
Figure 10B:
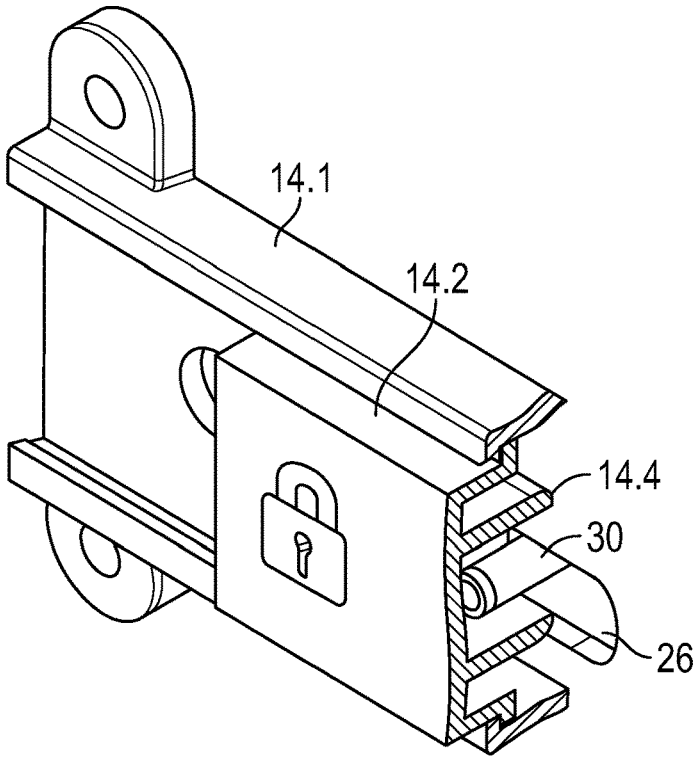
FIG. 10B is a perspective cutaway view of the indicator assembly illustrating its interaction with the locking bolt.

The embodiment of the lock body 10 shown in FIGS. 1, 2 and 6 also includes an indicator assembly 14 for indicating whether the locking bolt 13 is in the extended position or the retracted position. FIGS. 10A and 10B show the components of the indicator assembly 14 in more detail. The indicator assembly 14 includes slider mount 14.1 and symbol slider 14.3 slidably mounted on the slider mount 14.1. The slider mount 14.1 is provided with slot 14.2. The symbol slider 14.3 has a pin receptacle 14.4 on its side facing the lock body 10. The position of the pin receptacle 14.4 is schematically indicated in FIG. 10A with dashed lines. As shown in FIG. 10B, when the indicator assembly 14 is mounted on the lock body 10, slot 26 of the inner plate 11 is aligned with slot 14.2 of the slider mount 14.1 and pin 30 of the locking bolt 13 is received in slot 14.2 and in pin receptacle 14.4. Movement of the locking bolt 13 between the retracted and extended position causes sliding of the symbol slider 14.3 in horizontal direction and enables visually displaying whether the locking bolt 13 is in the extended or retracted position.

With continued reference to FIGS. 6, 8 and 9, the lock assembly 10 further includes a cylinder claw 19. The cylinder claw 19 can be rotated in CW or CCW direction with an authorized key from outside the door for returning the locking bolt 13 from its extended position to its retracted position or for triggering movement of the locking bolt 13 from its retracted to its extended position. The cylinder claw 19 has a cylindrical body 19" and claw arms 19' and 19'" extending radially from the cylindrical body 19". The cylinder claw 19 is rotatably supported in openings formed in the inner plate 11 and the outer plate 12 of the housing 9. The cylinder claw 19 is adapted for form fittingly receiving the cylinder tailpiece of a key cylinder (not shown) mounted in the door between the lock body and the outside of the door. Referring to FIGS. 8 and 9, the claw arm 19' is curved in CW direction and is aligned with the inner leg 13' of the locking bolt 13 while the claw arm 19'" is aligned with the lower leg 20" of bolt stopper 20. CW rotation of the cylinder claw 19 results in engagement of the claw arm 19' on the inner leg 13' and movement of the locking bolt 13 from the extended position shown in FIG. 9 to the retracted position shown in FIG. 8. CCW rotation of the cylinder claw 19 results in engagement of the claw arm 19'" with the lower leg 20" of the bolt stopper 20 and pivoting of the bolt stopper 20 to its upper position, allowing movement of the locking bolt 13 from its retracted position to its extended position.

Figure 7:
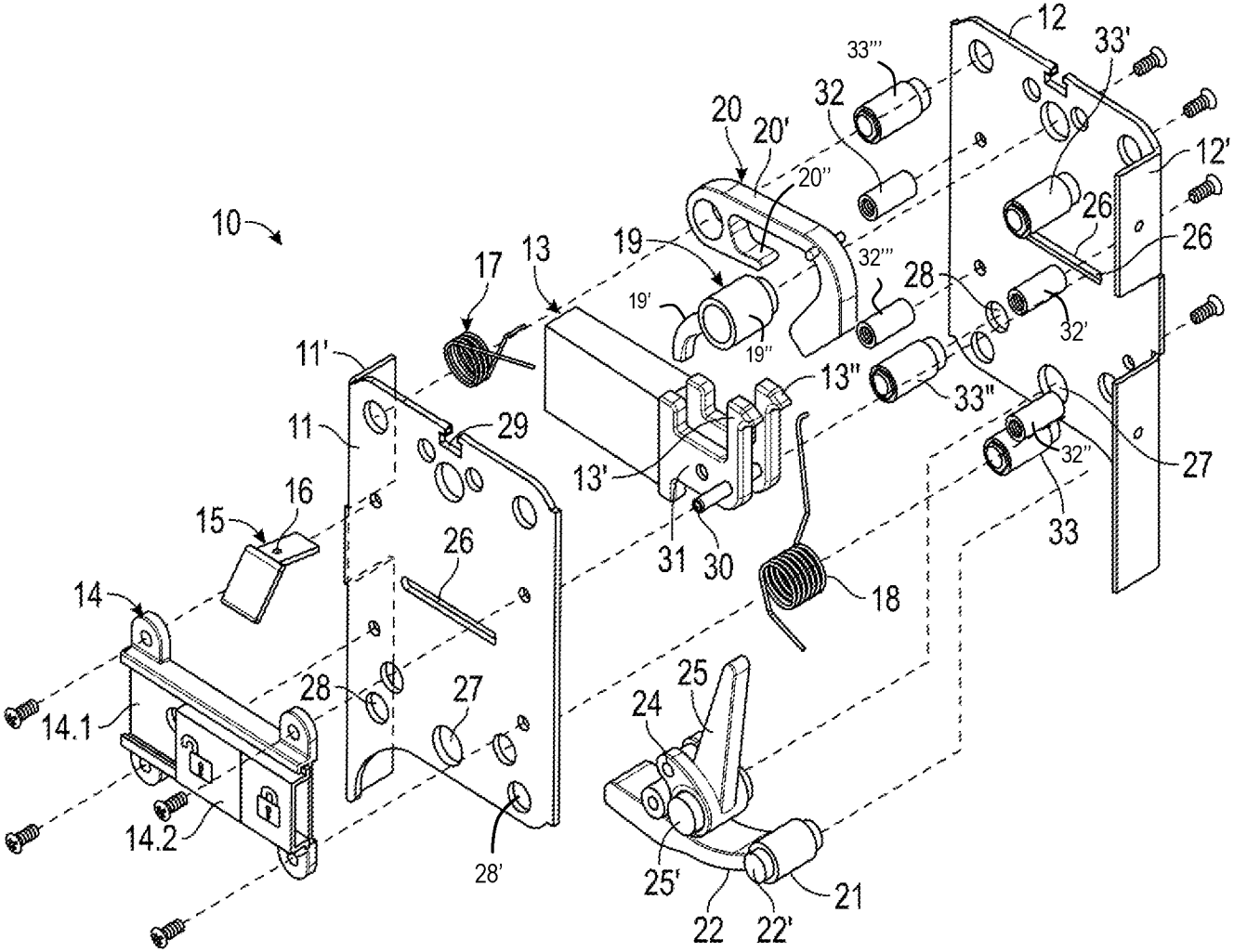
FIG. 7 is an exploded view of another embodiment of the lock body according to the present invention.

In the embodiment of the lock body 10 shown in FIGS. 6, 8 and 9, the locking bolt 13 extends from the right side of the lock body 10 to engage in a strike positioned on a door frame on the right side of the lock body 10. Another embodiment of the lock body 10, in which the locking bolt 13 extends from the left side of the lock body to engage in a strike positioned on a doorframe on the left side of the lock body is shown in FIG. 7. The components of the embodiment of the lock body 10 of FIG. 7 are the same as in the embodiment shown in FIG. 6 except for the cylinder claw 19 whose claw arm 19' is curved in CCW direction instead of CW direction. In addition, in the embodiment shown in FIG. 7, spring 17 and bolt stopper 20 are mounted on bushing 33'" instead of bushing 33' and spring 18 is mounted on bushing 33 instead of bushing 33". Further, in the embodiment of FIG. 7, pivot arm 22 of the pivot arm assembly 21 is supported in opening 28' of the housing instead of opening 28.

Figure 11A:
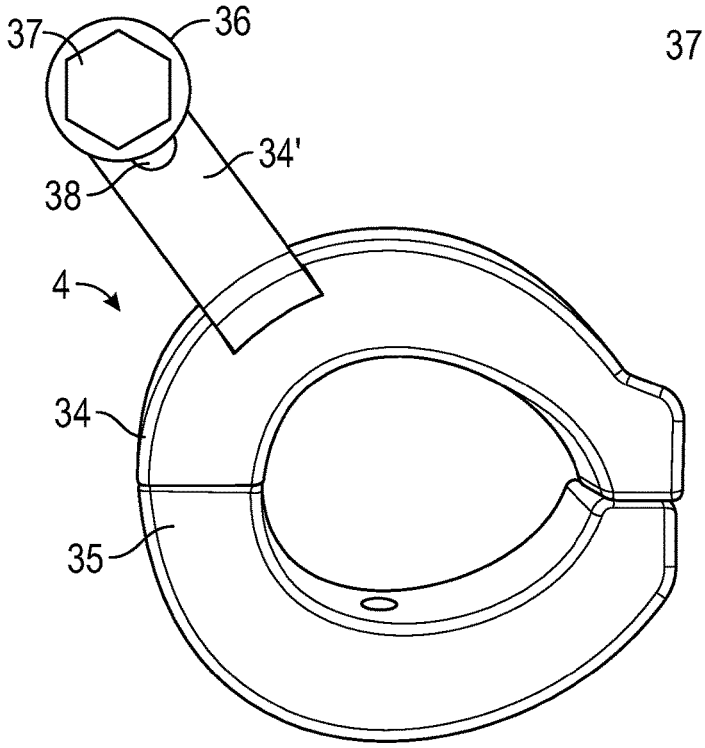
FIG. 11A is a perspective view of the door lever assembly shown in FIG. 1.
Figure 11B:
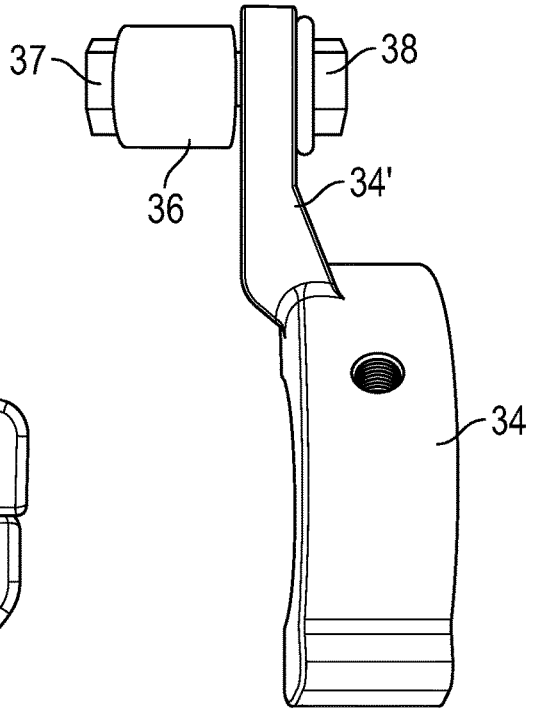
FIG. 11B is a side perspective view of the top bracket of the door lever assembly of FIG. 11A.

In the following, the structure of door lever assembly 4 and its interaction with components of the lock body 10 is described in more detail with reference to FIGS. 11-13. FIG. 11A shows a perspective front view of an embodiment of the door lever assembly 4 according to the present invention. The door lever assembly 4 has a top bracket 34 and a bottom bracket 35. The top bracket 34 has an actuator arm 34' provided with an oblong hole 38 in which stopper bolt 37 is received. A roller 36 is received on the stopper bolt 37. FIG. 11B shows a top perspective view of the top bracket further illustrating the relationship between the stopper bolt 37, the actuator arm 34' and the roller 36. The stopper bolt 37 can be fixed at different positions along the longitudinal extent of the oblong hole to adjust the distance between the roller 36 and the pivot arm 22 of the pivot arm assembly 21.

The roller 36 is a cylindrical sleeve that is rotatably received on the stopper bolt 37. The roller 36 is in rolling contact with the lower pivot arm 22 of the pivot arm assembly 21 when the door lever is actuated and the door lever assembly 4 rotates with the door lever. The roller 36 can be made of different materials. A currently preferred material for the roller is rubber, however, other materials such as steel or plastic can also be used for the roller 36.

Figure 11C:
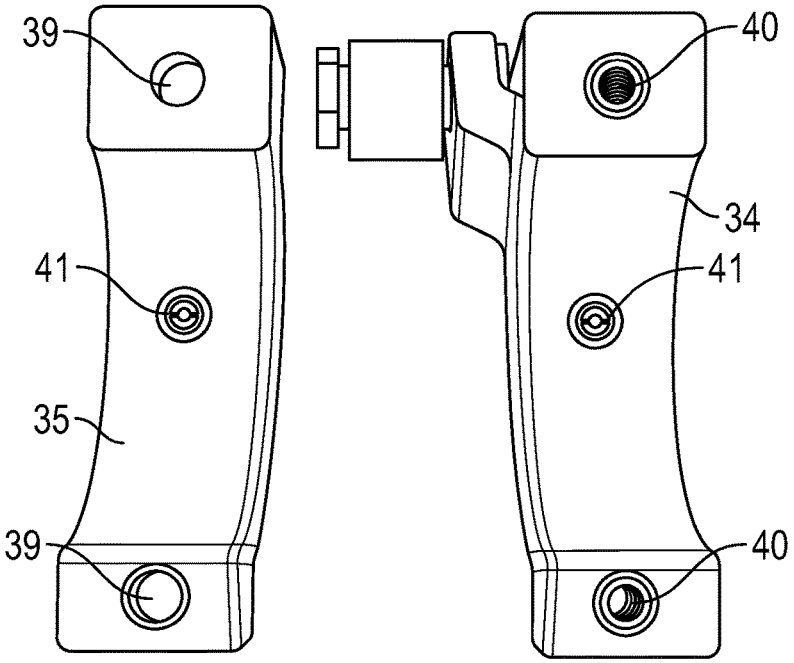
FIG. 11C is a perspective view of the top and bottom brackets of the door lever assembly showing the mating ends of the top and bottom brackets.

Referring to FIG. 11C, the bottom bracket 35 has openings 39 and the top bracket 34 has corresponding threaded holes 40 for securing the top and bottom brackets 34, 35 about the shaft of a door lever by inserting screws into openings 39 and threadably engaging the screws in the threaded holes 40. The top and bottom brackets 34, 35 further have radially extending screws 41 that can be turned radially inwardly to engage on the shaft of the door lever to secure the door lever assembly 4 in rotative fixed relationship with the shaft of the door lever.

Figure 12A:
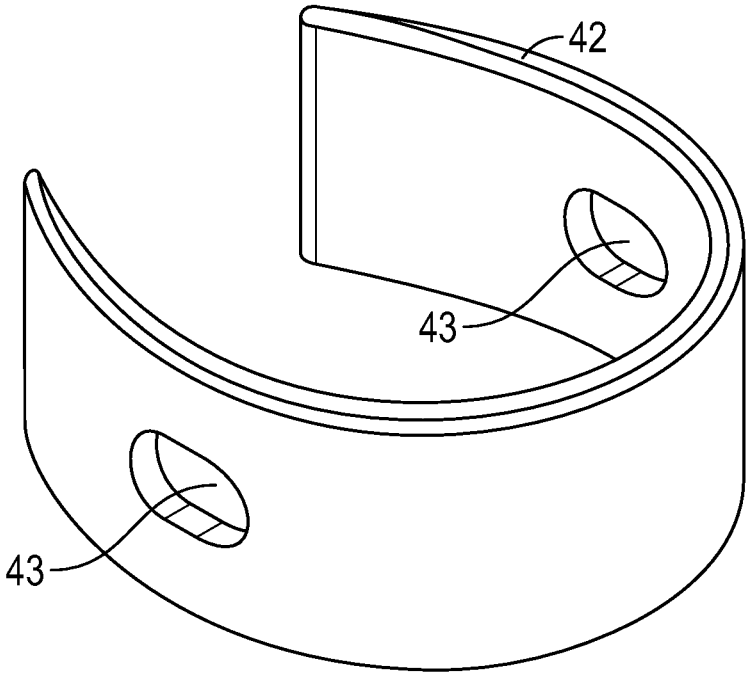
FIG. 12A is a perspective view of an insert sleeve for the door lever assembly according to the present invention.
Figure 12B:
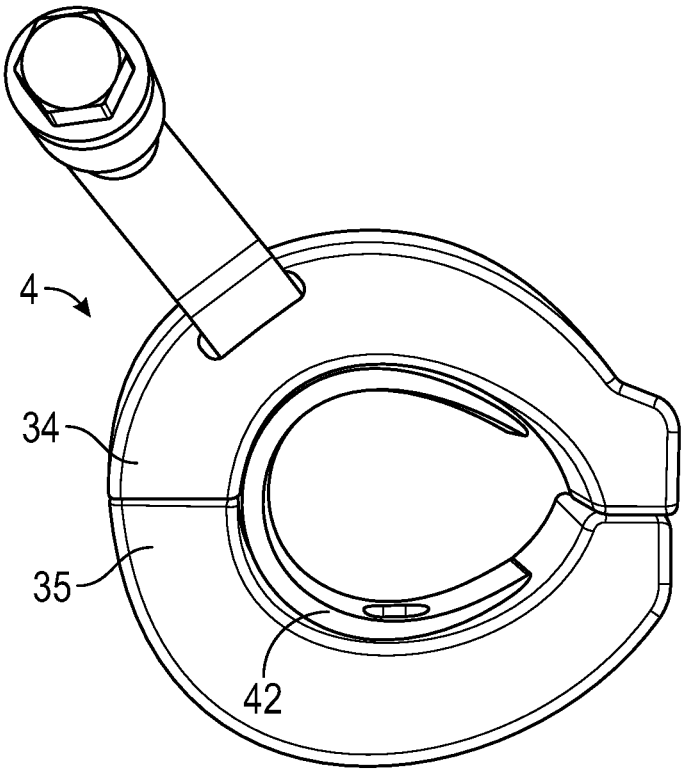
FIG. 12B is a perspective view of the door lever assembly of FIG. 12A with mounted insert sleeve.

In an embodiment, the door lever assembly 4 can further include an insert sleeve for facilitating mounting of the door lever assembly 4 to a door lever with predetermined diameter. FIG. 12A shows a perspective view of the insert sleeve 42. The insert sleeve is shaped to conform to the inner circumference defined by the top and bottom brackets 34, 35. The insert sleeve 42 has openings 43 for passage of the screws 41 of the top and bottom brackets 34, 35 therethrough to enable engagement of the screws 41 with the shaft of the door lever. FIG. 12B shows the insert sleeve 42 received in the door lever assembly 4.

Figure 13B:
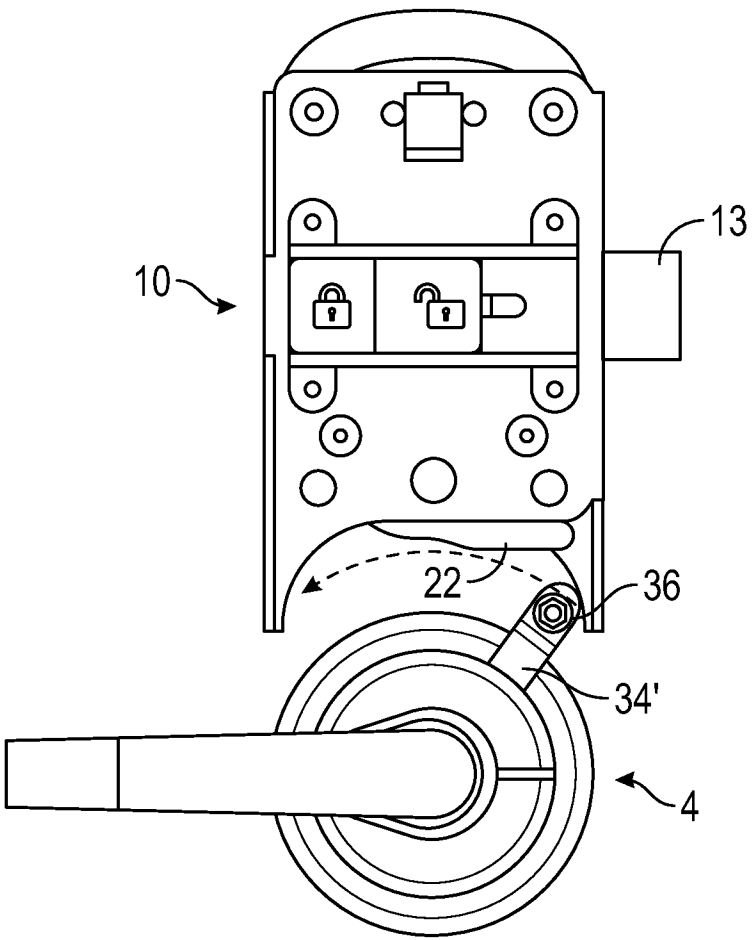
FIG. 13B is a plan view of an embodiment of the lock assembly according to the present invention with the locking bolt in the retracted position.
Figure 13A:
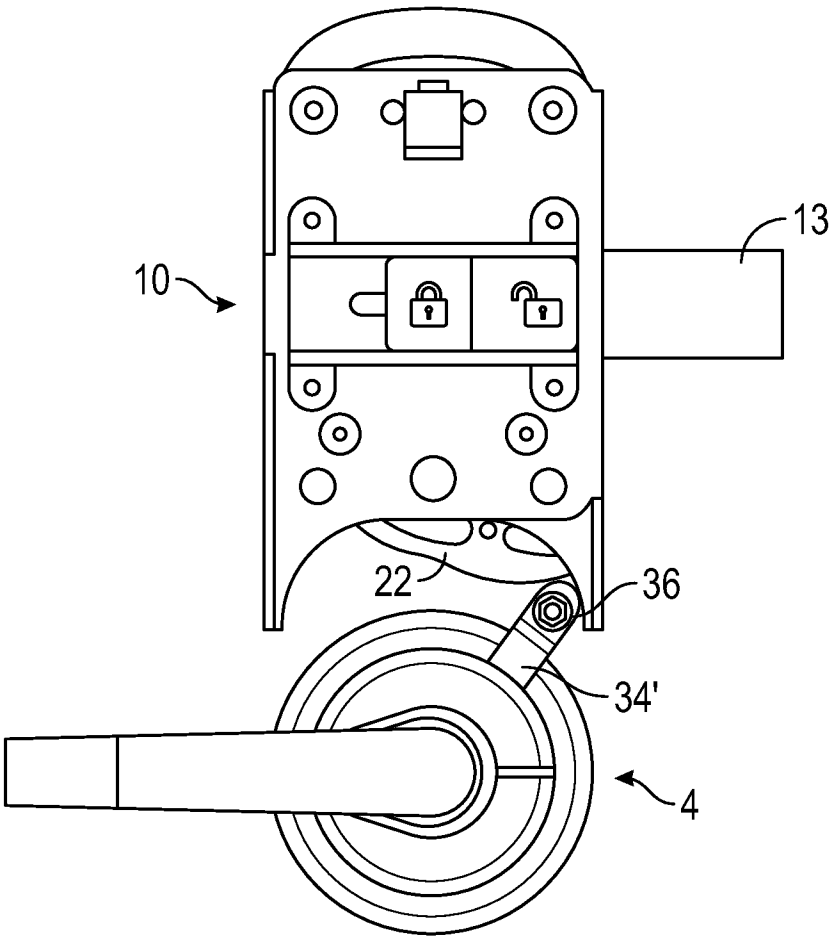
FIG. 13A is a plan view of an embodiment of the lock assembly according to the present invention with the locking bolt in the extended position.

FIG. 13 schematically illustrates the interaction of the door lever assembly 4 with the pivot arm assembly 21 of the lock body 1. FIG. 13A shows the locking bolt 13 in the extended position with the pivot arm 22 in the lower position. Downward pivoting of the door lever causes rotation of the actuator arm 34' along the path and in the direction indicated by the dashed arrow indicated in FIG. 13B and engagement of the roller 36 of the actuator arm 34' with the pivot arm 22. As a result, pivot arm 22 is moved to its upper position. Referring to FIGS. 8 and 9 upward movement of the pivot arm 22 results in rearward pivoting of upper pivot arm 25, that is pivoting to the left in the view shown in FIGS. 8 and 9, which causes movement of the locking bolt 13 from the extended to the retracted position. The distance between the lock body 10 and the roller 36 of the door lever assembly 4 is selected so that in the retracted position of the locking bolt 13, the door lever 6 can be turned without any impediment by the pivot arm 22 when the pivot arm 22 is in the upper position.

A person with skill in the art will recognize that other configurations of the door lever assembly described above are possible that are also within the scope of the invention. For example, the actuator arm 34' can be constructed without the roller 36 and configured so that the free end of the actuator arm 34' directly contacts the pivot arm 22 of the pivot arm assembly 21 instead of via the roller 36. In such an embodiment it is particularly advantageous when the contact surfaces of the pivot arm 22 and the free end of the actuator arm 34' are made of a material that minimizes friction when the end of the actuator arm 34' contacts the pivot arm 22 during rotation of the door lever assembly 4.

Another embodiment of the lock assembly according to the invention is shown in FIGS. 14-27 and is generally designated by reference numeral 100.

Figure 14:
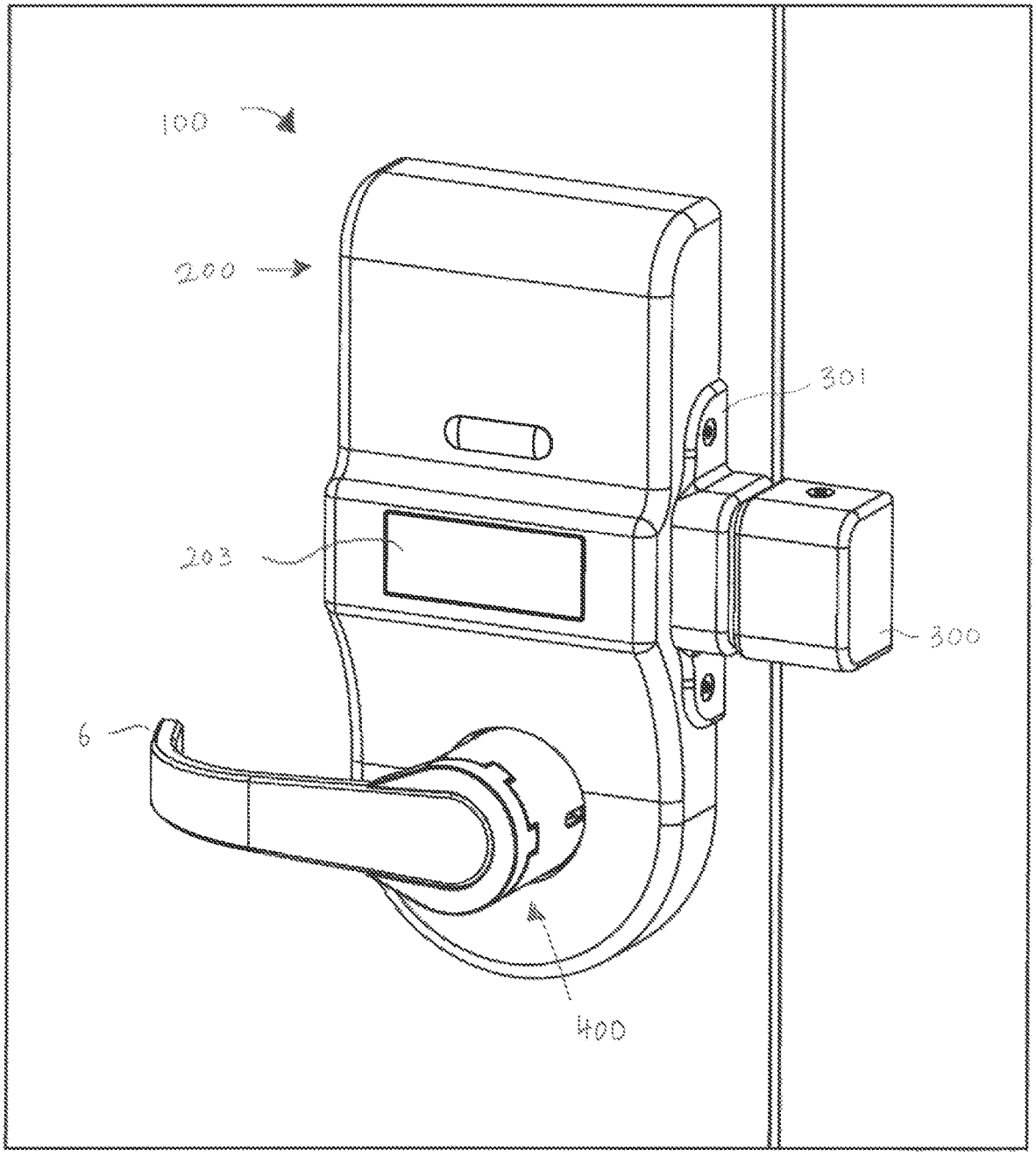
FIG. 14 is a perspective view of another embodiment of the lock assembly according to the present invention mounted on a door.
Figure 15:
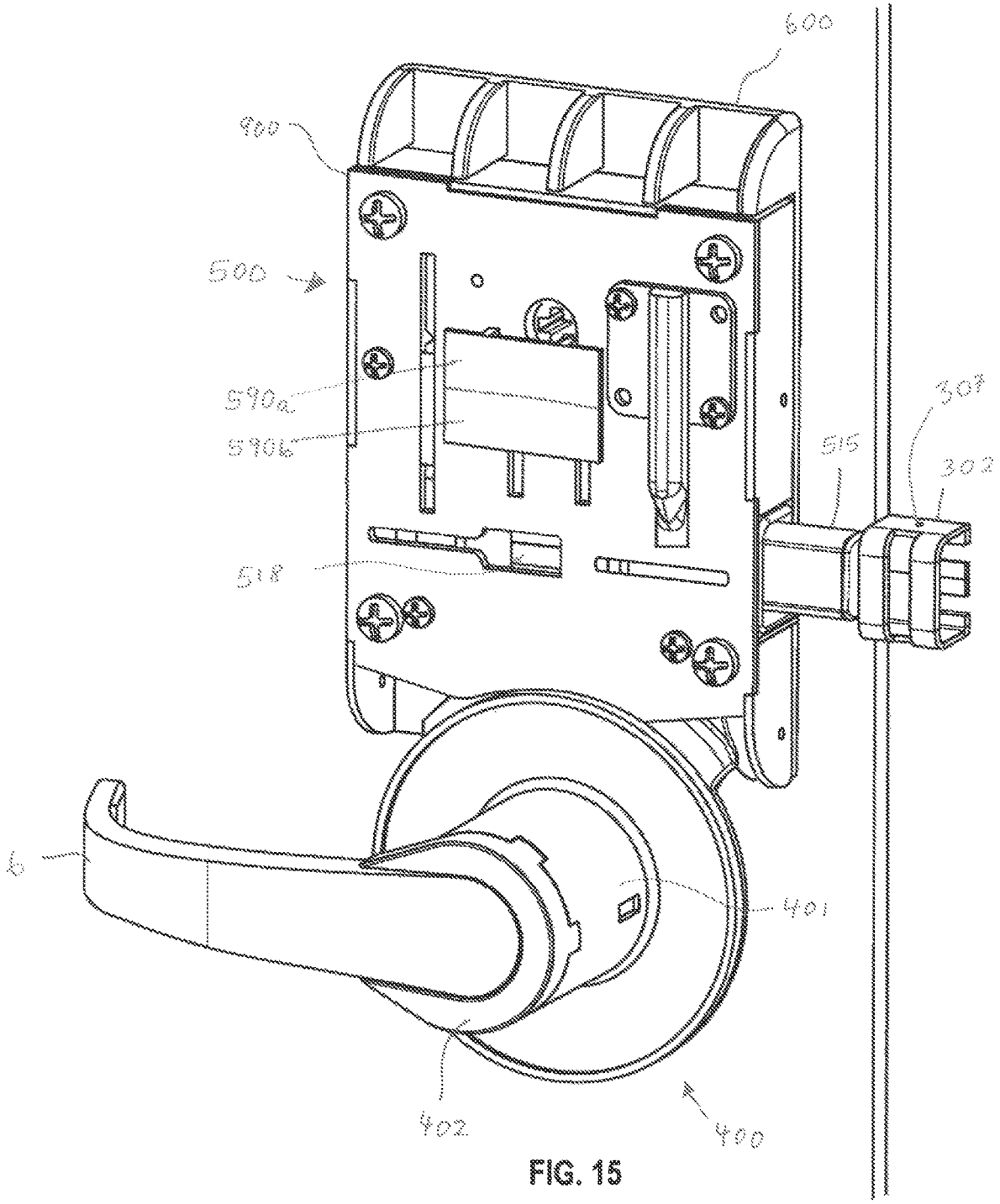
FIG. 15 shows the lock assembly of FIG. 14 with the cover assembly, strike cover and bolt cover removed.

Referring to FIG. 14, the lock assembly 100 includes a cover assembly 200, a door lever assembly 400, a bolt cover 301 and a strike cover 300. FIG. 15 shows the lock assembly 100 of FIG. 14 with the cover assembly 200, the bolt cover 301 and the strike cover 300 removed. As shown in FIG. 15, the lock assembly 100 further includes lock body 500, mounting plate 600 and strike 302.

Referring to FIG. 15, the lock body 500 has a housing 900 and a locking bolt 515 supported in the housing 900 for movement between a retracted position and an extended position. In FIG. 15, the locking bolt 515 is shown in its retracted position. The lock body 500 also includes a trigger body 518 for triggering movement of the locking bolt 515 from its retracted position to its extended position. The lock body 500 further includes an indicator plate 590 with an upper portion 590*a* and a lower portion 590*b* for indicating whether the locking bolt 515 is in the retraced or the extended position.

FIG. 15 also shows the door lever assembly 400 mounted on the door lever 6. The door lever assembly 400 includes a shaft piece 401 mounted on the shaft of the door lever 6 and a handle piece 402 engaged with and in rotative fixed relation with the shaft piece 401. The handle piece 402 has arms 406, 407 that respectively engage on the top and bottom sides of the door handle.

Figure 16:
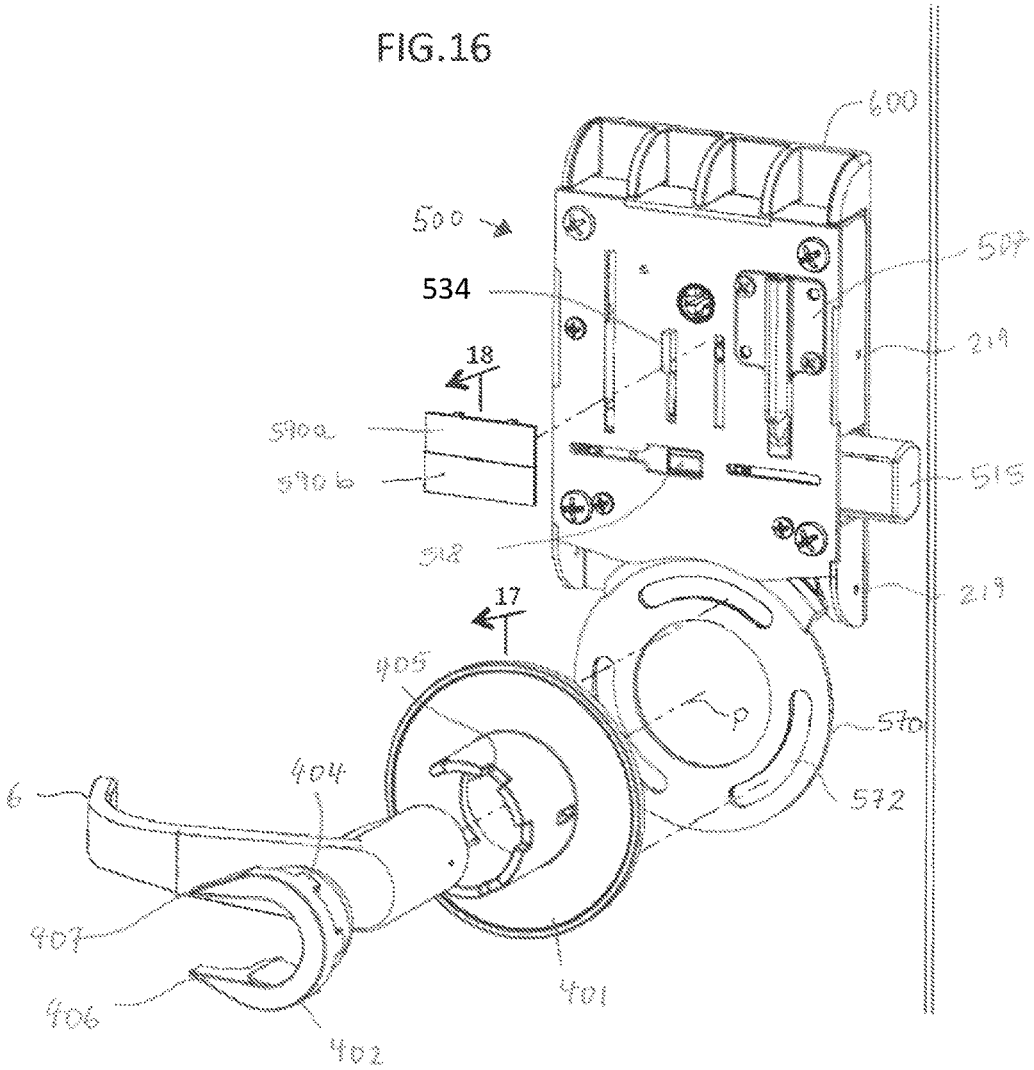
FIG. 16 shows an exploded view of the lock body and door lever assembly of the embodiment of FIG. 15.
Figure 17:
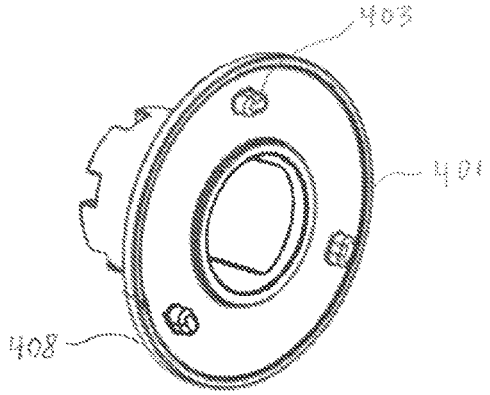
FIG. 17 shows a perspective view of the shaft sleeve of the door lever assembly of FIG. 16 taken along the direction of arrow 17.

FIGS. 16 and 17 further illustrate the relationship between the lock body 500 and the door lever assembly 400. The handle piece 402 of the door lever assembly 400 has serrations 404, which in the assembled state of the door lever assembly engage in notches 405 of the shaft piece 401. FIG. 17 shows the shaft piece 401 viewed in the direction indicated by arrow 17 in FIG. 16. The shaft piece 401 has a flange portion 408 with projections 403 provided on its side that faces the lock body 500. The projections 403 engage in respective circumferentially spaced apart curved slots 572 of the bolt actuator 570. In the assembled state, rotation of the door lever 6 causes rotation of the door lever assembly 400 and as a result engagement of the projections 403 in the ends of the curved slots 572 which in turn causes rotation of the actuator 570 about axis P shown in FIG. 16. The interaction of the actuator 570 with the other components of the lock body 500 will be described in more detail below.

Figure 18:
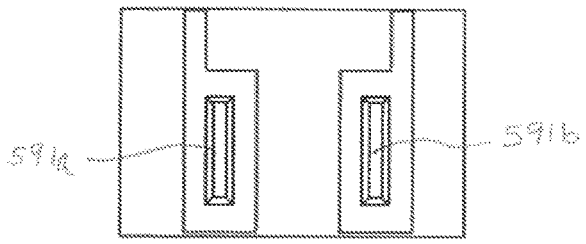
FIG. 18 is a plan view of the indicator plate of FIG. 16 taken along the direction of arrow 18.

FIGS. 16 and 18 further illustrate the mounting of the indicator plate 590. The indicator plate 590 has receptacles 591*a*, 591*b* on its side facing the housing 900 of the lock body 500 and is mounted on ridge 534 via frictional engagement of the ridge 534 in receptacle 591*a*.

Figure 19A:
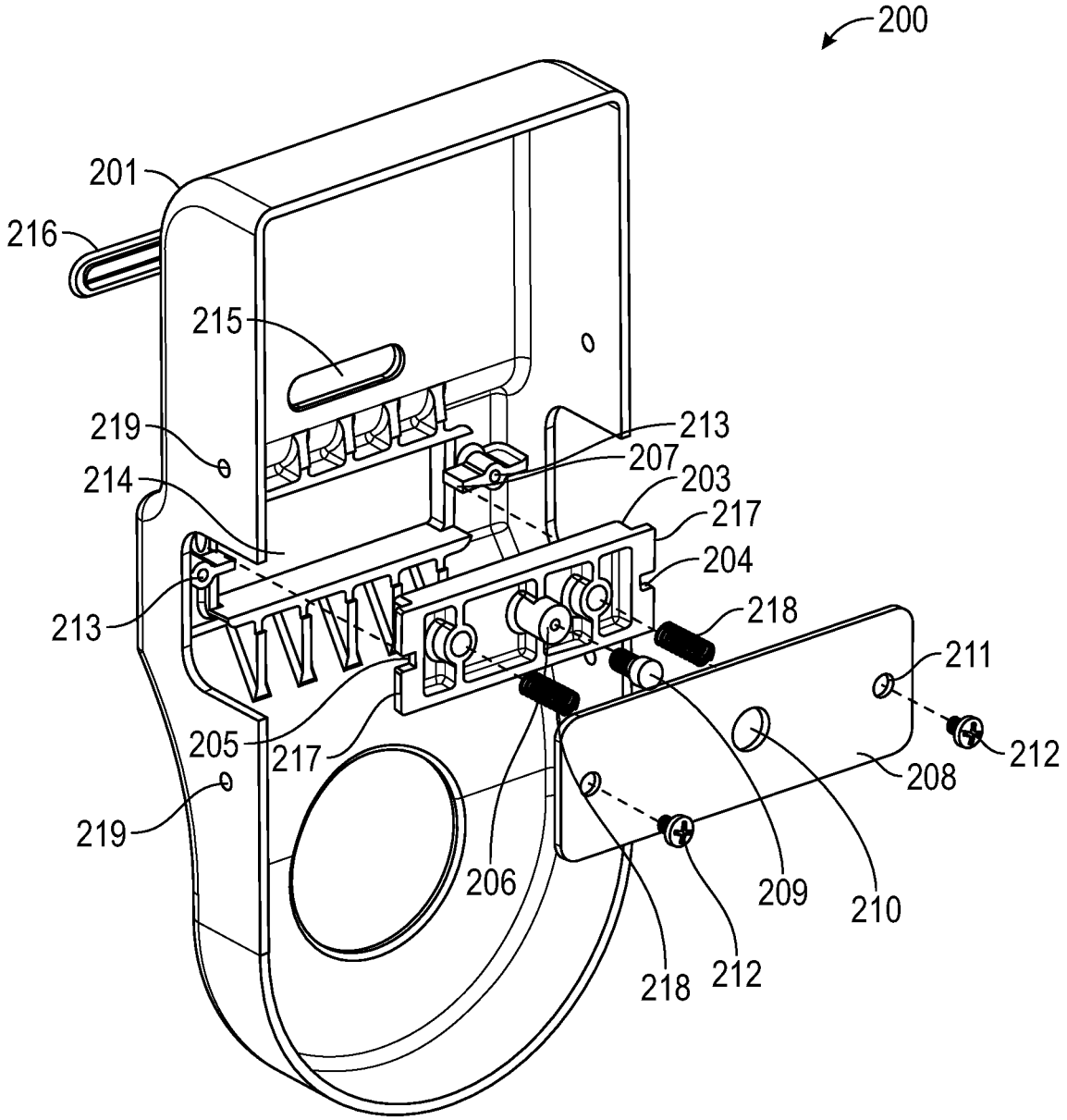
FIG. 19A is an exploded view of the cover assembly of FIG. 19A.
Figure 19B:
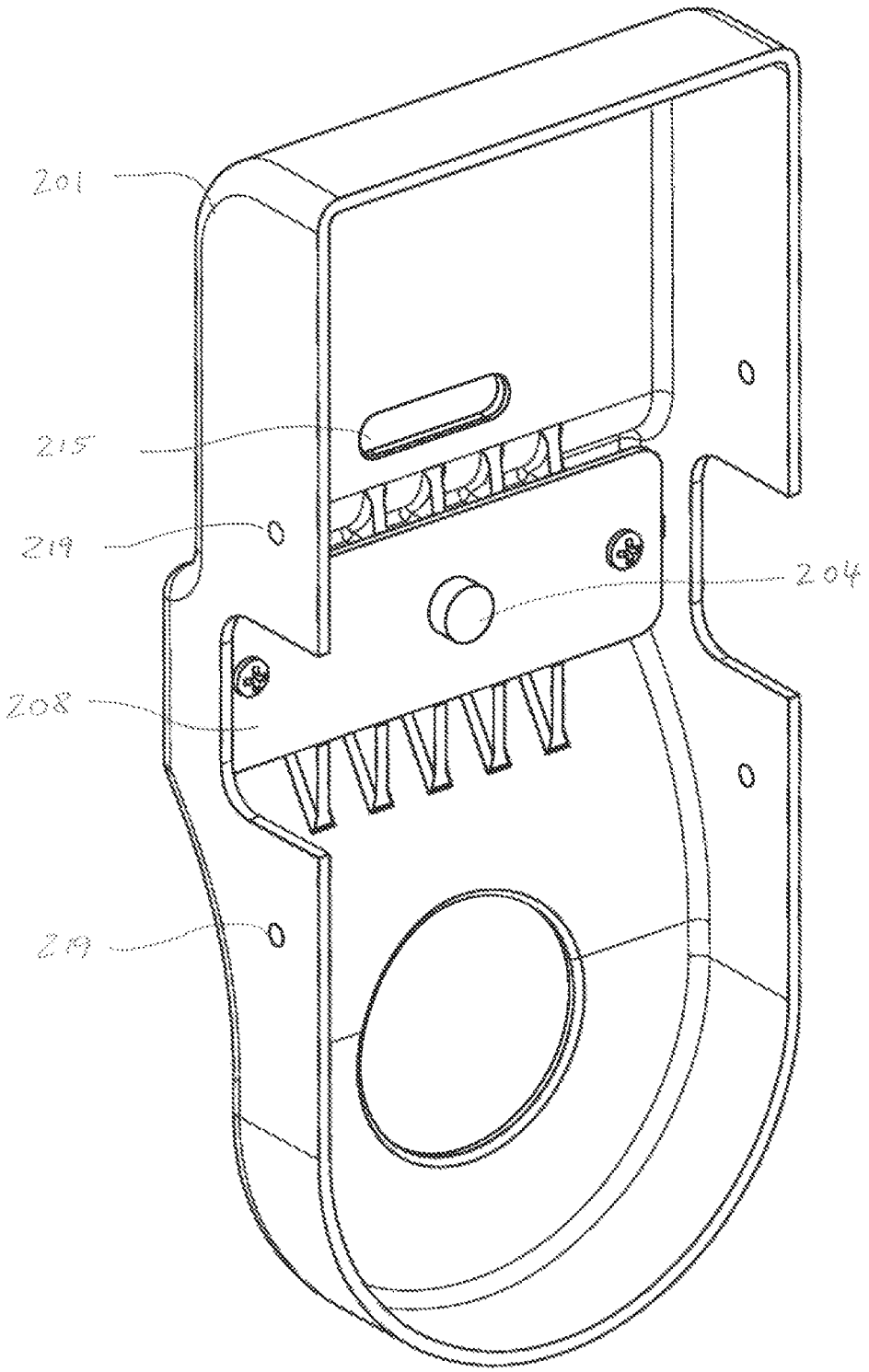
FIG. 19B is a perspective view of the inside of the cover assembly of FIG. 14.

Referring now to FIG. 19A, there is shown a perspective inside exploded view of the cover assembly 200 shown in FIG. 14. The cover assembly 200 includes a cover 201, and a pushbutton 203 received in opening 214 of the cover 200. The pushbutton 203 has flanges 217 provided with notches 204 and is slidably supported on mounts 207 via the notches 204 normal to the front face of the cover 201. Movement of the pushbutton 203 in the direction away from the lock body 500 is limited by engagement of the flanges 217 with respective sidewalls of the opening 214. Movement of the pushbutton 203 in the direction toward the lock body 500 is limited by plate member 208, which is secured by screws 212 received in holes 213 formed in the cover 201. Springs 218 are provided between the pushbutton 203 and the plate member 208. The pushbutton 203 has a contact element 209 secured in hole 206. In the assembled state of the cover assembly 200, the contact element 209 projects through opening 210 formed in the plate member 208. The cover 201 of the cover assembly 200 is further provided with window 215 in which lens 216 is received. FIG. 19B shows the cover assembly 200 in its assembled state. Pushing on the pushbutton 203 from outside the cover 201 causes movement of the contact element 209 toward the lock body 500.

Figure 20:
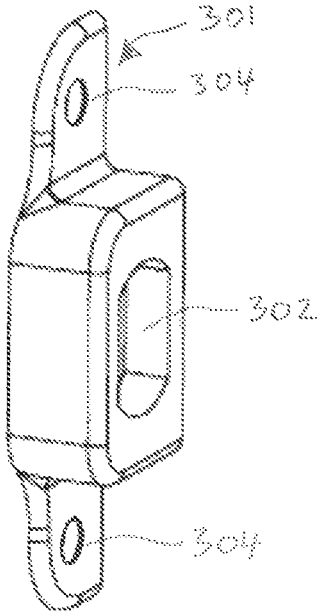
FIG. 20 is a perspective view of the bolt cover of FIG. 14.

FIG. 20 shows a perspective view of the bolt cover 301 shown in FIG. 14. The bolt cover 301 has an opening 302 for passage of the locking bolt 515, and through holes 304 for securing the bolt cover 301 on the lock body 500 with screws in corresponding holes 219 provided in the lock body 500.

Figure 21:
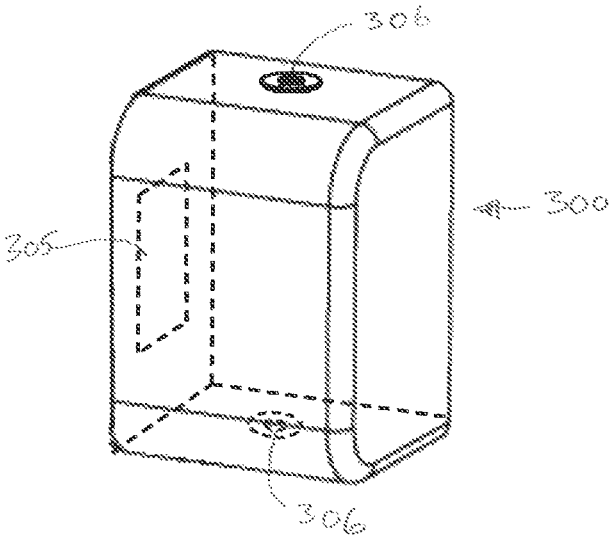
FIG. 21 is a perspective view of the strike cover of FIG. 14.

FIG. 21 shows a perspective view of the strike cover 300 of FIG. 14. The strike cover 300 is shaped to accommodate strike 302 and has an opening 305 for receiving the bolt 515. The strike cover 300 is secured on the strike 307 by screws that are passed through openings 306 and are threadably engaged in corresponding openings 307 in the strike 302.

Figure 22:
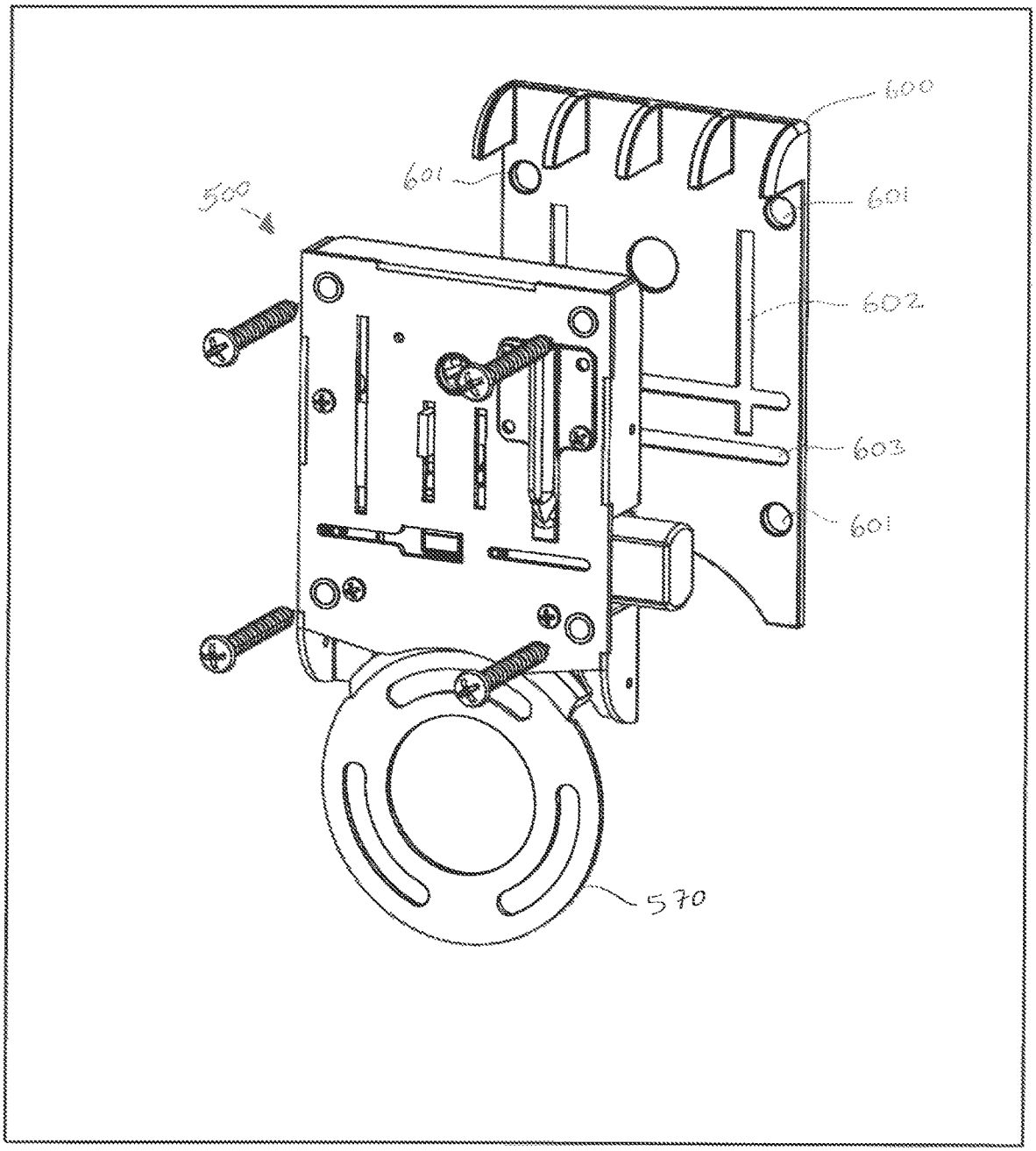
FIG. 22 is a perspective view of the lock body and spacer plate of the lock assembly of FIG. 16.

FIG. 22 shows an exploded view of the lock body 500 and the mounting plate 600. The mounting plate 600 has holes 601 for receiving screws for securing the lock body 500 and the mounting plate 600 on the door. The mounting plate 600 further has slots 602, 603 that are aligned with corresponding slots formed in the outer plate 502 of the lock body 500.

Figure 23:
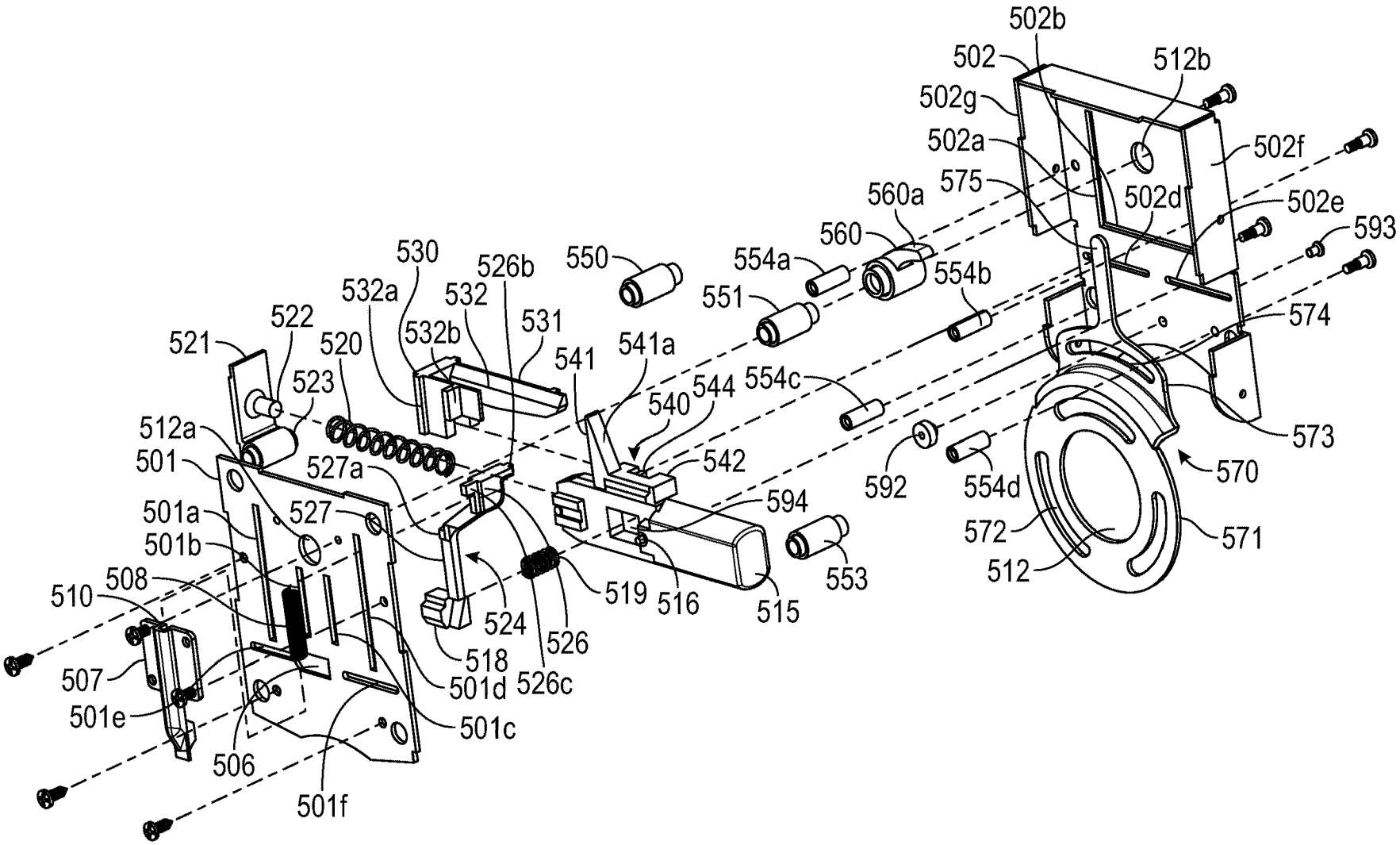
FIG. 23 shows an exploded view of the lock body of the lock assembly of FIG. 15.
Figure 25:
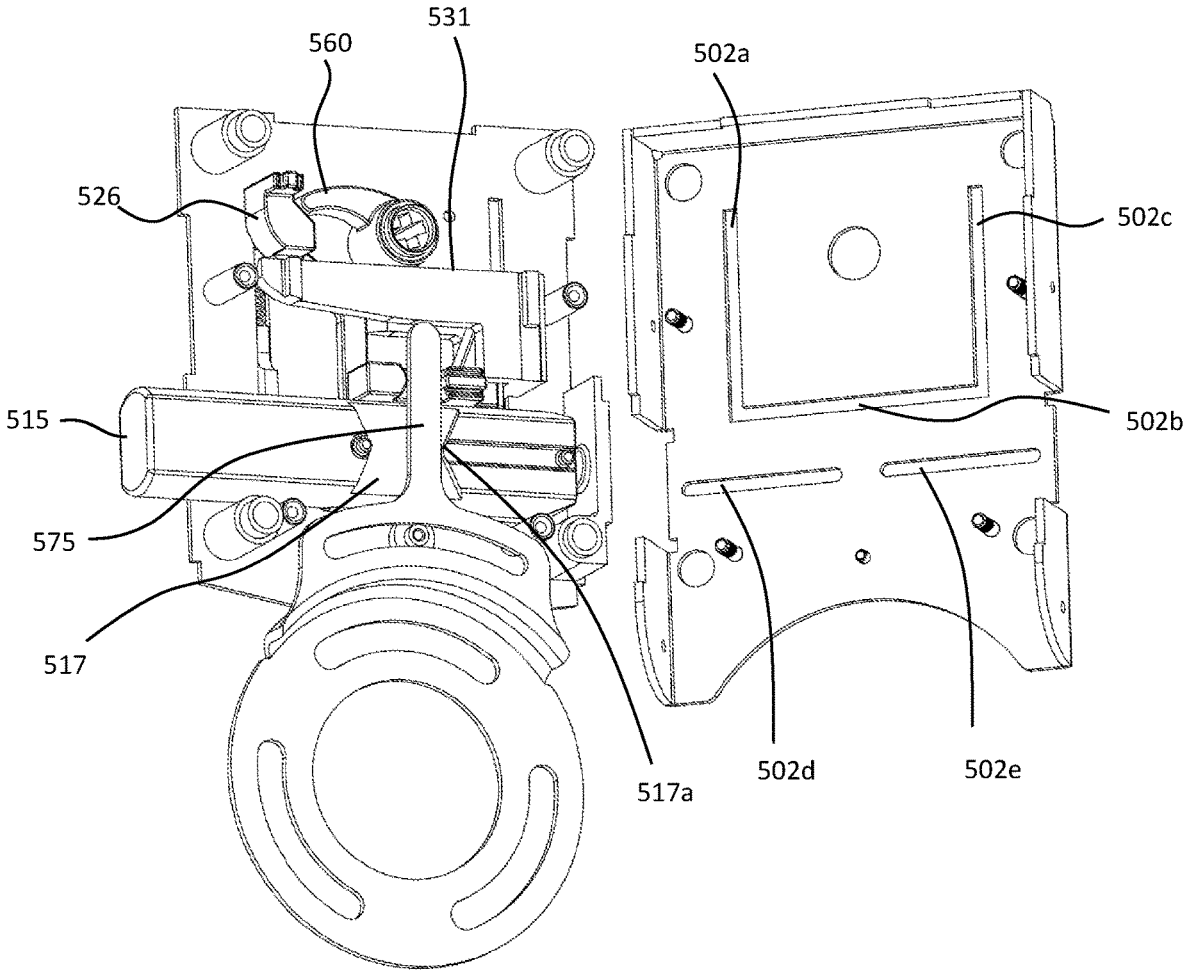
FIG. 25 shows an internal view of the lock body of the lock assembly of FIG. 18 taken from the side of the outer plate with the locking bolt in the retracted position.
Figure 26:
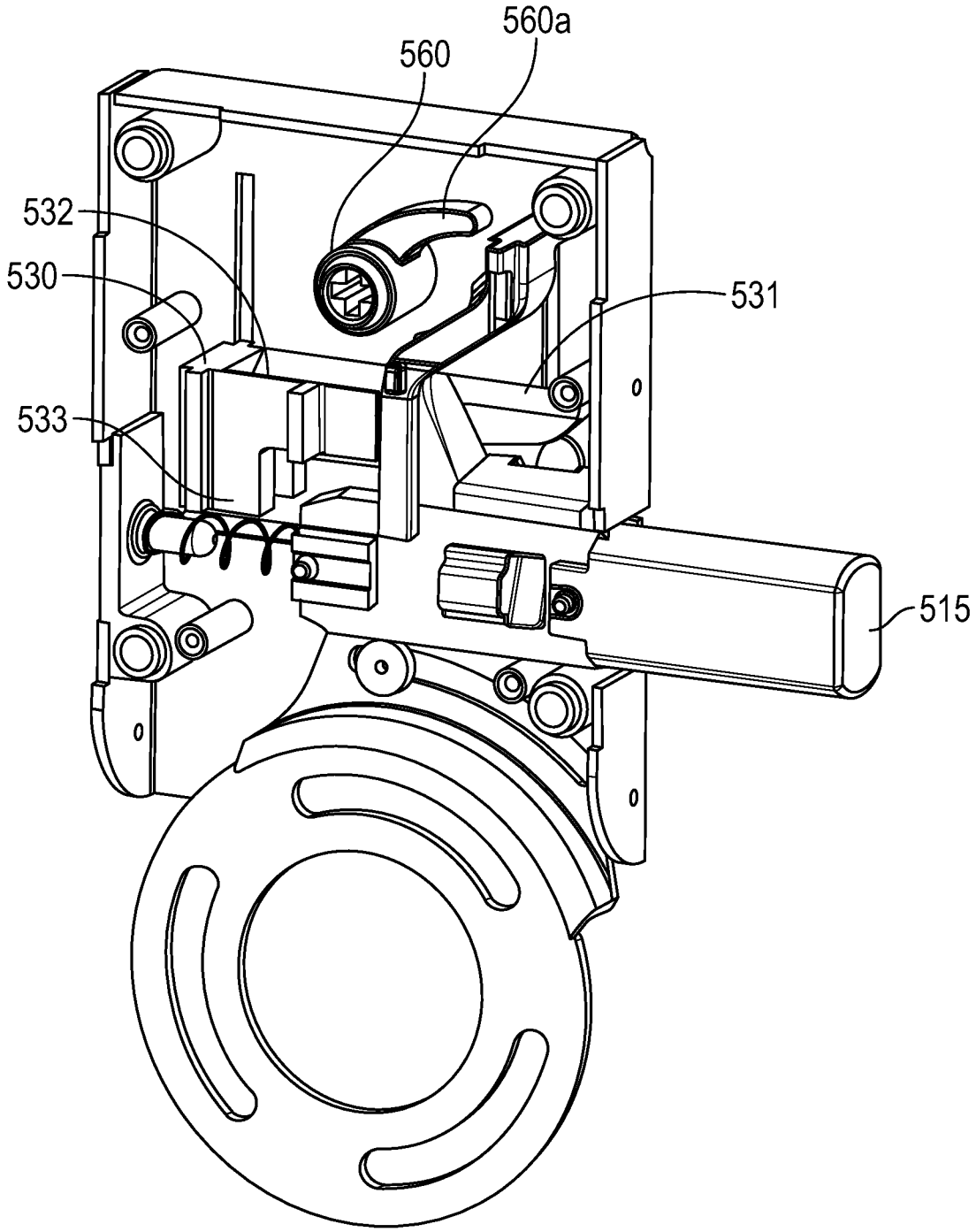
FIG. 26 shows an internal view of the lock body of the lock assembly of FIG. 18 with the locking bolt in the extended position.
Figure 27:
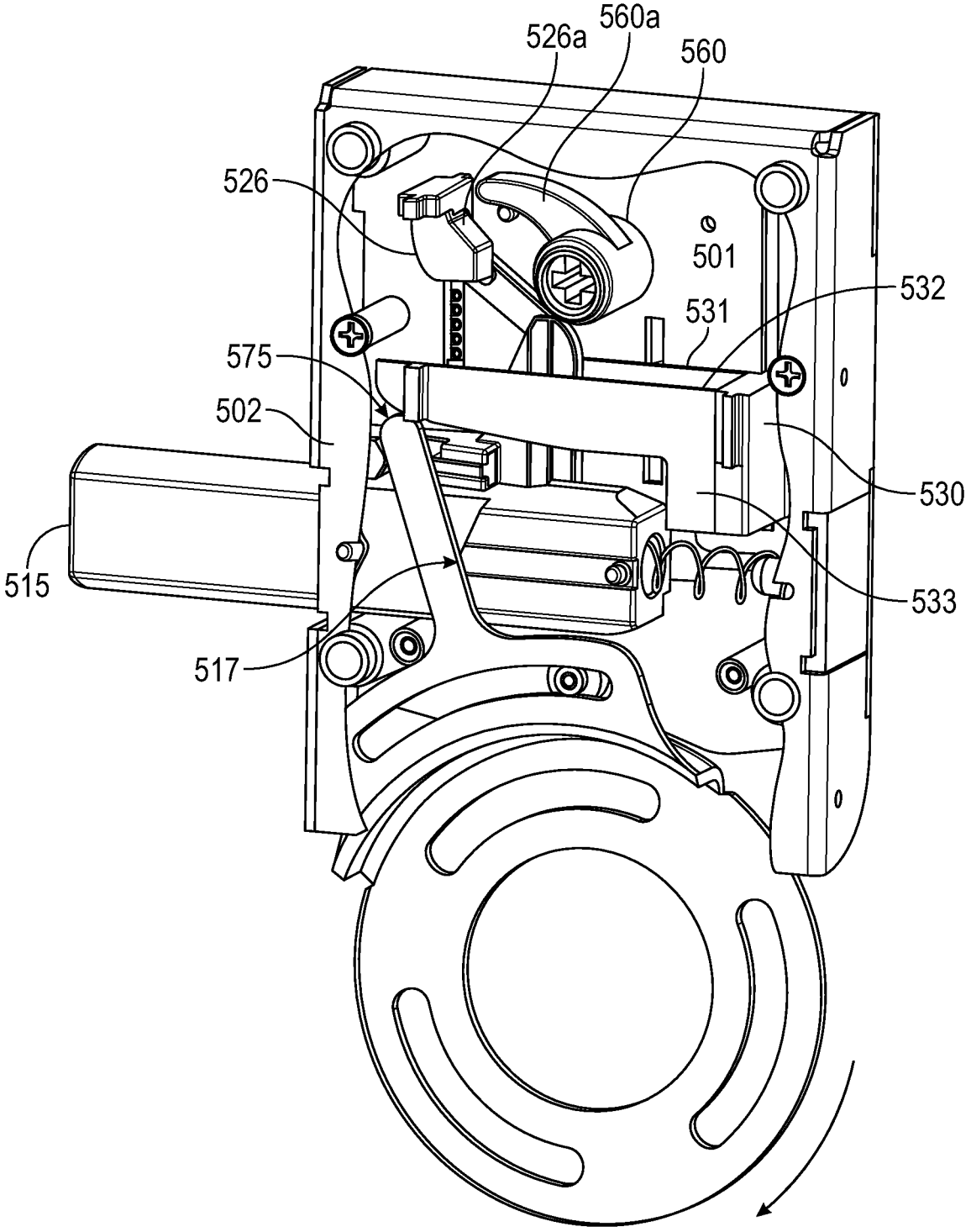
FIG. 27 shows an internal view of the lock body of the lock assembly of FIG. 18 taken from the side of the outer plate with the outer late partially broken away and with the locking bolt in the extended position.

In the following, the relative arrangement and interaction of the components of the lock body 500 is explained with reference to FIGS. 23-27. FIG. 23 shows a front side exploded view of the lock body 500 shown in FIG. 15. FIGS. 24 and 26 show respective internal views of the lock body 500 with the locking bolt 515 in the retracted position. FIGS. 26-27 show respective internal views of the lock body 500 with the locking bolt 515 in the extended position.

Figure 24A:
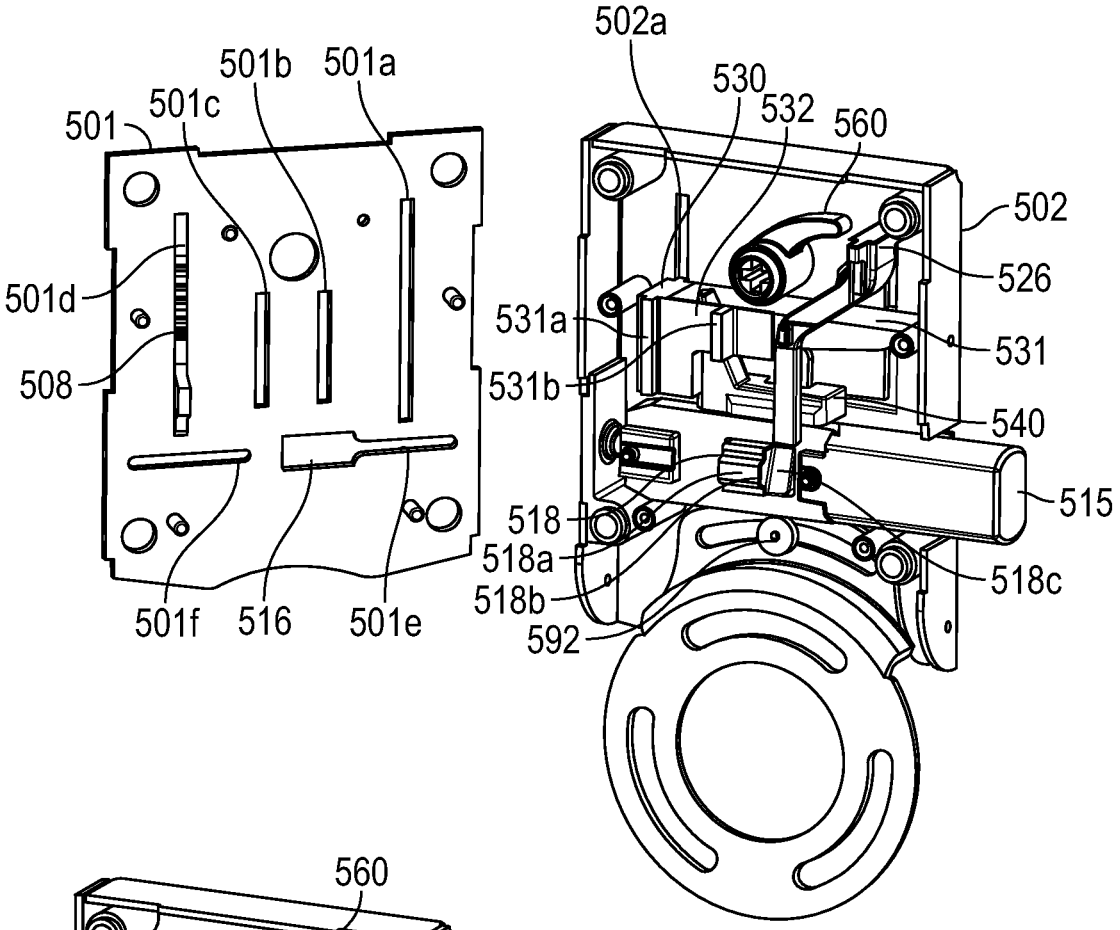
FIG. 24 A shows the lock body of FIG. 18 with the inner plate 12 removed and the locking bolt in the retracted position.
Figure 24B:
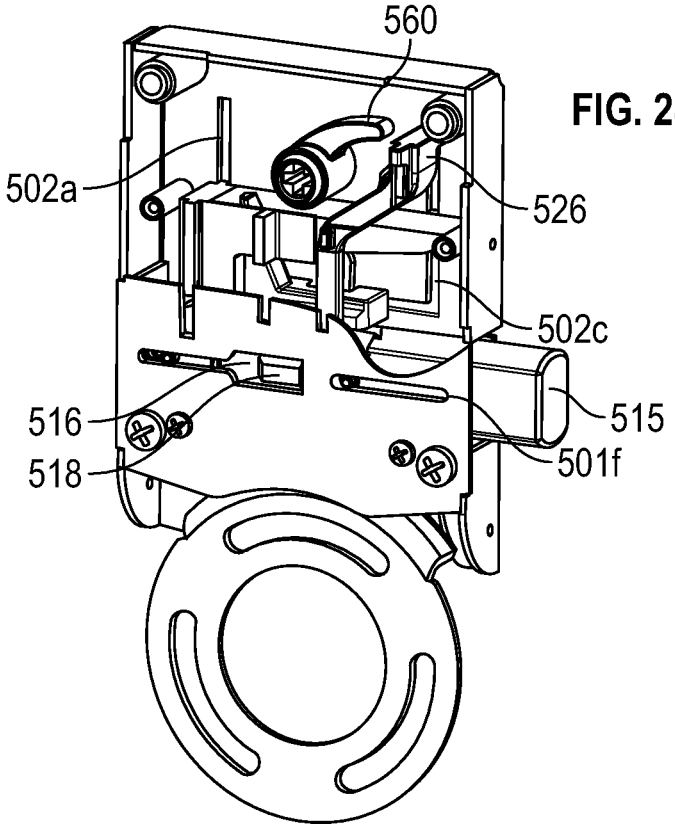

Referring to FIGS. 23 and 24A-B, the lock body 500 includes inner and outer plates 501 and 502 that form the housing 900 of the lock body 500. The outer plate 502 has angled portions that form front and rear walls 502*f*, 502*g* of the housing 900 of the lock body 500. Bushings 550, 551, 553 and bushing portion 523 of spacer element 521 serve as spacers between the inner and outer plates 501, 502. The inner and outer plates are secured to each other by screws that engage from the outside of the lock body 500 in threaded sleeves 554*a*-*d*.

The lock body 500 includes a locking bolt 515 supported via pins 516 in respective horizontal slots 501*e*, 501*f*, 502*d*, 502*e* of the inner and outer plates 501, 502 for movement of the locking bolt 515 between a retracted position and an extended position. The locking bolt 515 is biased toward the extended position by spring 520. The spring 520 is received in an axial bore on the rear end of the locking bolt 515 and is supported on pin 522 of spacer element 521.

The locking bolt 515 is held in the retracted position by trigger body 518. The trigger body 518 is received in a correspondingly shaped receptacle 592 on the inner side of the locking bolt 515 and is biased toward the inner plate 501 by a spring 519 arranged between the trigger body 518 and the base of the receptacle 592. In the retracted position of the locking bolt 515, spring 519 pushes the trigger body 518 toward the opening 506 of inner plate 501 so that ridge 518*a* of the trigger body 518 engages in the opening 506 and the front edge 518*b* of the ridge 518*a* engages the front edge of the opening 506, thereby holding the locking bolt 515 in the retracted position in opposition to the spring force exerted by spring 520.

Movement of the locking bolt 515 from the retracted to the extended position is triggered by pushing the pushbutton 203 of the cover assembly 200 in the direction of the lock body 500. The pushbutton 203 of the cover assembly 200 is arranged so that the contact element 209 of the pushbutton 203 is aligned with the trigger body 518 when the cover assembly 200 is mounted on the lock body 500. Pushing the pushbutton 203 causes engagement of the contact element 209 of the pushbutton 203 on the trigger body 518, which results in movement of the trigger body 518 into the receptacle 592 and disengagement of the trigger body 518 from the opening 506.

Movement of the locking bolt 515 from the retracted to the extended position can also be triggered with a key from outside the door. Referring to FIGS. 23 and 25, the lock body 500 further includes cylinder claw 560 and angled actuator 524. The cylinder claw 560 is rotatably received in holes 512*a*, 512*b* in the inner and outer plates 501, 502 and has a through opening shaped for positive engagement with the tailpiece of a key cylinder mounted between the lock body 500 and the outer face of the door. The angled actuator 524 has a head portion 526 and an angled leg 527 extending from the head portion 526. The angled actuator 524 is slidably supported in vertical slots 501*c* and 501*d* of the inner plate 502 and in vertical slot 502*c* of the outer plate 502 via respective ridges 526*c*, 526*d* and 527*a* provided on the head portion 526 and the angled leg 527 for movement of the angled actuator 524 between an upper and a lower position. The angled actuator 524 is biased toward the upper position by spring 505, which is received in spring holder 510 and engages under ridge 526*a* of the angled actuator 524. The free end of the angled leg 527 is aligned with the slanted surface 518*c* of the trigger body 518.

Turning the cylinder claw in CW direction causes engagement of the curved arm 560*a* of the cylinder claw 560 on the slanted surface 526*a* of the head portion 526 of the angled actuator 524, which results in movement of the angled actuator 524 to the lower position against the bias of spring 508. As a result, the free end of the angled leg 527 of the angled actuator 524 engages on the slanted surface 518*c* of the trigger body 518 and pushes the trigger body 518 into the receptacle 592 of the locking bolt 515 and out of engagement with the opening 506, thereby allowing movement of the locking bolt 515 from the retracted to the extended position. Further rotation of the cylinder claw 560 in CW direction results in disengagement of the claw arm 506*a* from the slanted surface 526*a* of the head portion 526 and return of the angled actuator 524 to the upper position as a result of the bias of spring 508.

Referring to FIG. 23, the lock body 500 also includes actuator 570, deadbolt element 530 and slider 540. In the following, the structure of these components and their interaction with each other and the locking bolt 515 during movement of the locking bolt 515 from the retracted to the extended position is described in more detail.

The actuator 570 has a circular portion 571 with a circular opening 512 and a pivot arm 575 connected to the circular portion 571 by flange portion 573. The actuator 570 is supported in the lock body 500 via engagement of screw 592 in curved slot 574 provided in the flange portion 573. In the assembled state of the lock assembly 100, the actuator 570 is received on the shaft of the door lever via circular opening 512 and is pivotal about pivot axis P shown in FIG. 16.

The deadbolt element 530 has parallel, spaced apart arms 531, 532 that are provided with respective ridges 531*a*, 531*b*, 532*a*, 532*b*. The ridges 531*a*, 531*b*, 532*a*, 532*b* engage in respective vertical slots 501*a*, 501*b*, 502*a*, 502*c* of the inner and outer plates 501, 502 and support the deadbolt element 530 in the lock body 500 for movement in vertical direction between an upper position and a lower position. Referring to FIG. 16, ridge 532*b* of the deadbolt element 530 extends out of the lock body 500 through slot 501*b* and engages in recess 591*a* of indicator plate 590. In the upper position of the deadbolt element 530, the lower portion 590*b* of the indicator plate 590 is displayed in the window 215 of the cover 201 and in the lower position of the deadbolt element 530 the upper portion 590*a* of the indicator plate 590 is displayed in the window 215 the cover 201.

The slider 540 is positioned directly above the locking bolt 515 and has first and second legs 541 and 542. The first leg 541 extends upward between the inner and outer arms 531, 532 of the deadbolt element 530 and has a slanted surface 541*a* facing toward the front of the lock body 500. The second leg 542 extends horizontally in the direction of the longitudinal extent of the locking bolt 515. The outward facing side of the second leg 542 is provided with opening 544 and ridge 542*a*. Ridge 542*a* is received in horizontal slot 502*b* of outer plate 502 and supports the slider 540 for sliding movement in horizontal slot 502*b*.

FIG. 25 shows the relative position of the locking bolt 515, the actuator 570, the deadbolt element 530 and the slider 540 when the locking bolt 515 is in the retracted position. FIG. 25 shows an internal view of the lock body taken from the side of the outer plate 502 with the outer plate 502 folded open. The pivot arm 575 of the actuator 570 is in an upright position and engages in recess 517 of the locking bolt 515 and in opening 544 of slider 540. The free end of the pivot arm 575 engages under the outer arm 531 of the deadbolt element 530 and holds the deadbolt element 530 in its upper position.

Movement of the locking bolt 515 from the retracted to the extended position causes engagement of the rear edge 517*a* of recess 517 on pivot arm 575 and frontward pivoting of the actuator 570 about the pivot axis P indicated in FIG. 16.

FIGS. 26 and 27 show the relative arrangement of the components of the lock body 500 when the locking bolt 515 is in the extended position. FIG. 26 shows an internal view of the lock body 500 taken from the side of the inner plate 501 and FIG. 27 shows an internal view of the lock body 500 taken from the side of the outer plate 502. When the locking bolt 515 is in the extended position, the free end of pivot arm 575 is positioned under the upward slanted end of the outer arm 531 of the deadbolt element 530 which permits the deadbolt element 530 to move to its lower position. In this position, the vertical portion 533 of the deadbolt element 530 intersects with the return path of the locking bolt 515 and prevents return of the locking bolt 515 to its retracted position. FIGS. 26 and 27, also show that frontward pivoting of the pivot arm 575 of the actuator 570 has caused slider 540 to slide frontward to the shown position.

The locking bolt 515 can be returned to its retracted position either by turning the door lever on the inside of the door or with an authorized key from outside the door.

Turning the door lever 6 to open the door causes CCW rotation of the door lever assembly 400 about axis P indicated in FIG. 16. As a result, the projections 403 of the door lever assembly 400 engage in the ends of the curved slots 572 of actuator 570 and cause inward rotation of the actuator 570. This causes the free end of pivot arm 575 to slide along the curved end of outer arm 531 of the deadbolt element 530, thereby lifting the deadbolt element 530 to its upper position and out of the return path of the locking bolt 515 to its retracted position. Simultaneously, pivot arm 575 of actuator 570 moves locking bolt 515 to its retracted position via engagement of the pivot arm 575 with the rear edge 517*a* of recess 517 of locking bolt 515.

In order to return the locking bolt 515 to its retracted position with an authorized key from outside the door, the authorized key is inserted into a key cylinder whose tailpiece is in positive engagement with the cylinder claw 560. The key is then turned so that the cylinder claw 560 rotates in CW direction. CW rotation of the cylinder claw 560 causes engagement of the claw arm 560*a* on the slanted surface 526*a* of the angled actuator 524 and inward movement of the slider 540. As a result of the engagement of pivot arm 575 in the opening 544 of slider 540, inward movement of the slider causes CCW pivoting of pivot arm 575, which in turn results in engagement of the pivot arm 575 on the rear edge 517*a* of recess 517 of the locking bolt 515 and movement of the locking bolt 515 from its extended to its retracted position.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

The invention claimed is:

1. A lock assembly for a door, comprising:

a lock body for mounting above a door lever of the door and comprising a locking bolt supported in a housing of the lock body for movement between a retracted position and an extended position, said locking bolt being held in the retracted position in opposition to a spring force biasing the locking bolt toward the extended position;

a trigger operatively coupled with the locking bolt and accessible and actuatable in a closed position of the door to release the locking bolt from the retracted position; wherein the trigger is connected to a bias member that connects to a pushbutton; and a door lever assembly adapted for detachable mounting on the door lever outside the lock body housing and in rotative fixed relationship with the door lever, said door lever assembly when mounted on the door lever outside the lock housing operatively coupled with the locking bolt so that rotation of the door lever assembly causes movement of the locking bolt from the extended position to the retracted position.

2. The lock assembly of claim 1, wherein the trigger is actuatable in response to a force applied on the trigger in a direction of the housing.

3. The lock assembly of claim 1, wherein the door lever assembly is operatively coupled with the locking bolt via a pivot arm supported in the housing for pivoting between an upper position and a lower position, wherein movement of the pivot arm from the lower position to the upper position causes movement of the locking bolt from the extended position to the retracted position, and rotation of the door lever assembly causes pivoting of the pivot arm from the lower position to the upper position.

4. The lock assembly of claim 3, wherein the door lever assembly comprises an actuator arm extending radially from the door lever assembly in a direction of the pivot arm of the lock body, wherein rotation of the door lever assembly causes engagement of the actuator arm on the pivot arm and movement of the pivot arm from the lower to the upper position.

5. The lock assembly of claim 4, wherein the door lever assembly further comprises a threaded bolt received in an oblong hole provided in the actuator arm and extending along a longitudinal extent of the actuator arm, and a roller being rotatably received on the threaded bolt, wherein the threaded bolt is adapted for adjustment of a position of the threaded bolt in the oblong hole along the longitudinal extent of the actuator arm.

6. The lock assembly of claim 3, wherein the door lever assembly is movable without obstruction by the pivot arm of the lock body when the pivot arm is in the upper position.

7. The lock assembly of claim 1, wherein the lock body further comprises a bolt stopper supported in the housing for pivoting in response to actuation of the trigger from a holding position in which the bolt stopper holds the locking bolt in the retracted position, to a release position permitting movement of the locking bolt from the retracted to the extended position.

8. The lock assembly of claim 1, further comprising a cover assembly mounted on the lock body, said cover, assembly comprising a cover and the pushbutton supported in the cover for movement in a direction of the lock body for actuation of the trigger.

9. The lock assembly of claim 1, wherein the door lever assembly comprises a top bracket and a bottom bracket adapted for mounting about a shaft of the door lever so that the shaft of the door lever is received between the top bracket and the bottom bracket.

10. The lock assembly of claim 1, wherein the door lever assembly is operatively coupled with the locking bolt via an actuator supported in the housing for pivoting between a rear position and a front position, wherein pivoting of the actuator from the front position to the rear position causes movement of the locking bolt from the extended position to the retracted position, and rotation of the door lever assembly causes pivoting of the actuator from the front position to the rear position.

11. The lock assembly of claim 10, wherein the door lever assembly comprises a handle portion and a shaft portion in rotative fixed engagement with each other, said handle portion and said shaft portion adapted for mounting on the door lever so that the handle portion engages about a handle of the door lever and the shaft portion is received on the shaft of the door lever, said shaft portion coupled to said actuator via engagement of protrusions of the shaft portion in openings in a circular portion of the actuator.

12. The lock assembly of claim 1, further comprising a trigger body resiliently supported in a recess formed on a side of the locking bolt, said trigger body movable in the recess between a holding position in which the trigger body holds the locking bolt in the retracted position via engagement of the trigger body with an opening in the front side of the housing, and a release position permitting movement of the locking bolt front the retracted to the extended position.

13. The lock assembly of claim 1, wherein the door lever assembly comprises a handle portion and a shaft portion adapted for mounting on the door lever so that the handle portion engages about a handle of the door lever and the shaft portion is received on the shaft of the door lever.

* * * * *